United States Patent [19]

Scheurich et al.

[11] Patent Number: 4,457,209

[45] Date of Patent: Jul. 3, 1984

[54] AUTOMATED LARGE CALIBER AMMUNITION HANDLING SYSTEM

[75] Inventors: John L. Scheurich, Excelsior; Gary J. Nelson, Buffalo, both of Minn.

[73] Assignee: FMC Corporation, Chicago, Ill.

[21] Appl. No.: 443,341

[22] Filed: Nov. 19, 1982

Related U.S. Application Data

[63] Continuation of Ser. No. 181,575, Aug. 27, 1980, abandoned.

[51] Int. Cl.[3] ..... F41F 9/06

[52] U.S. Cl. ..... 89/45; 89/34; 89/47

[58] Field of Search ..... 89/33 A, 33 B, 34, 36 H, 89/36 K, 45, 46, 47, 135

[56] References Cited

U.S. PATENT DOCUMENTS

| | | | |
|---|---|---|---|
| 947,600 | 1/1910 | Schneider | 89/47 |
| 1,360,523 | 11/1920 | Hadcock et al. | 89/33 A |
| 3,122,967 | 3/1964 | Johnson et al. | 89/46 |
| 3,218,930 | 11/1965 | Girouard et al. | 89/45 |
| 3,331,284 | 7/1967 | Case et al. | 89/135 |
| 4,183,281 | 1/1980 | Hultgren et al. | 89/47 |
| 4,380,950 | 4/1983 | Renoux | 89/45 |

FOREIGN PATENT DOCUMENTS

| | | | |
|---|---|---|---|
| 53-33000 | 3/1978 | Japan | 89/46 |
| 1251176 | 10/1971 | United Kingdom . | |

*Primary Examiner*—Stephen C. Bentley
*Attorney, Agent, or Firm*—H. M. Stanley; R. B. Megley

[57] ABSTRACT

A large caliber cannon such as a 155 mm Howitzer uses ammunition rounds consisting of a projectile and a propellant charge which are loaded in sequence into the breech of the cannon. The cannon is mounted on a gun carriage and is free to move in elevation on the carriage about an elevation axis. The carriage is controllable in azimuth for gun pointing. Storage drums for holding a plurality of projectiles and charges are mounted on the carriage. Projectile trays and propellant charge trays are positioned to receive the projectiles and their propellant charges from the storage drums. The trays are pivotally mounted on cradle arms so that they may be rotated between a receiving position and a gun loading position. The cradle arms are pivotally mounted on the gun carriage so that they may be moved between the elevation of the receiving position and a position in alignment with the breech when the cannon is being trained. A control is provided which actuates mechanism to transfer the projectiles and charges from the storage drums to the trays and from the trays to the breech. The control monitors the position of the system mechanical components and actuates them in appropriate sequence so that a series of ammunition rounds are delivered from the drums to the breech.

12 Claims, 19 Drawing Figures

11
97
230
227
229
228
98
226
224
222
57
58
218
219
231
232
223
221
46
64
9
192
193
352
194
198
197
196
51
48
202
201
203
204
199
217
52
211
212
213
56
31
214
216
54
236
237
241
233
234
99

FIG_9
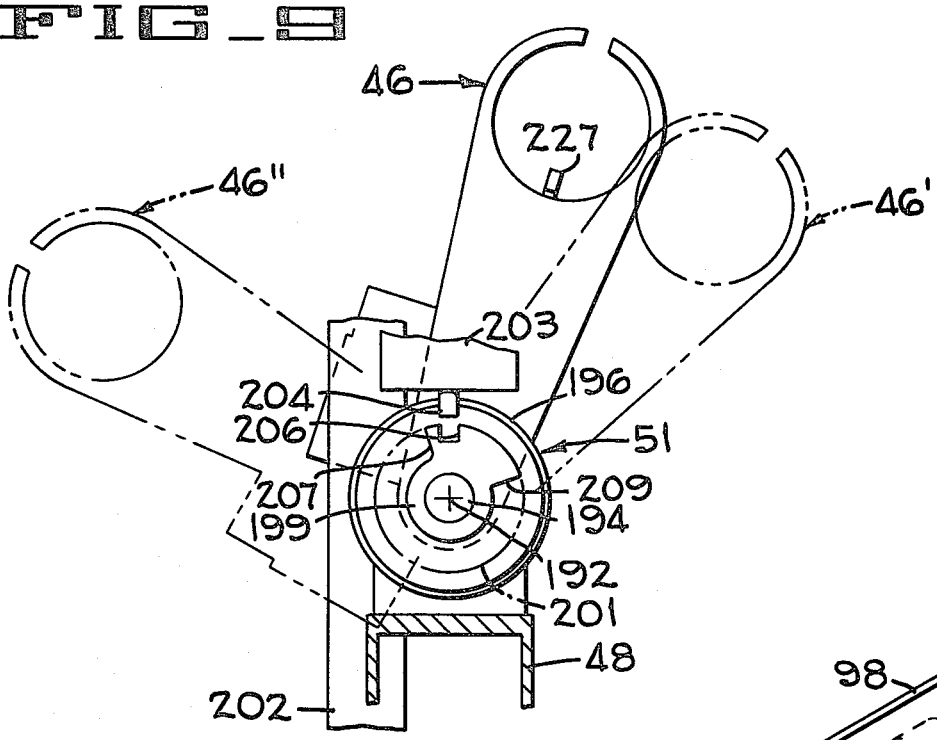
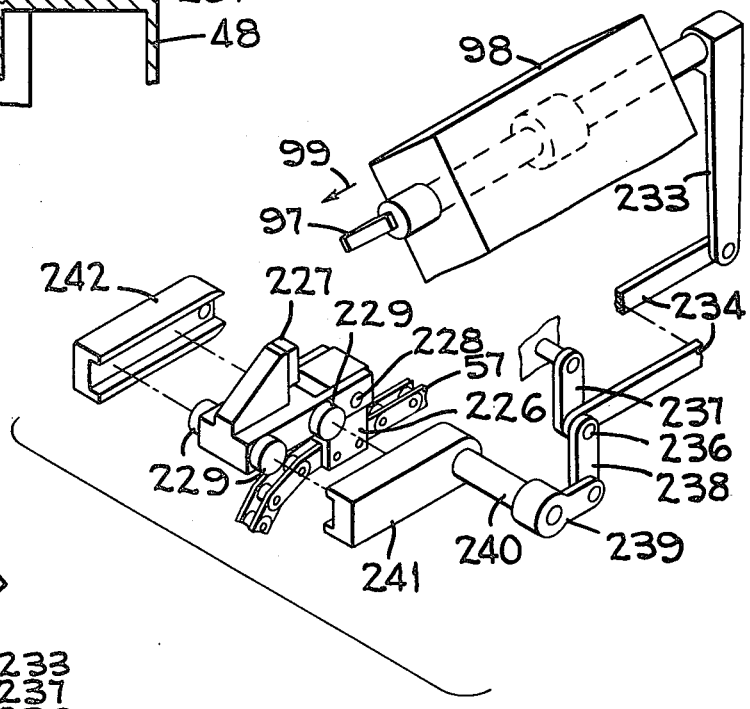
FIG_10
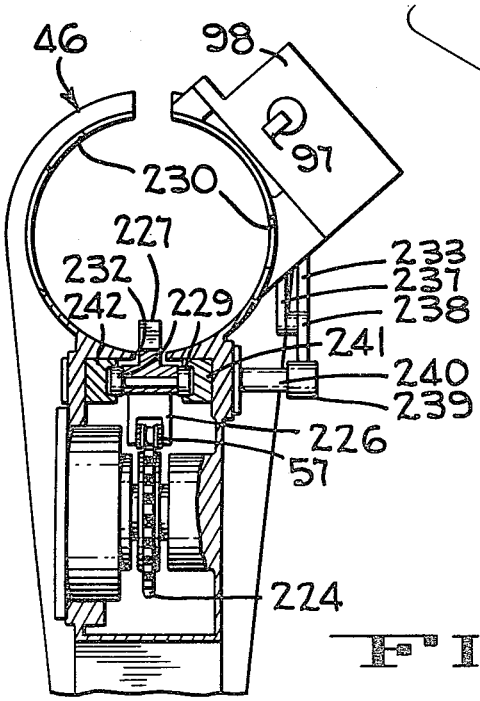
FIG_11

AUTOMATED LARGE CALIBER AMMUNITION HANDLING SYSTEM

This application is a continuation of application Ser. No. 181,575, filed Aug. 27, 1980 now abandoned.

BACKGROUND OF THE INVENTION

1. Field of the Invention

This invention relates to an ammunition loading system for a large caliber cannon and more particularly to such a system which automatically delivers a series of rounds to the breech of the cannon.

2. Description of the Prior Art

Ammunition in general consists of three parts; a projectile, a propelling charge and a primer. Large caliber ammunition usually falls into two categories. "Separate ammunition" is the term applied to ammunition in which all three parts are separate and are brought together only at the breech of a cannon. "Semi-fixed ammunition" is the other type of large caliber ammunition wherein the projectile is separate but the propellant and the primer are fixed together. A third type of ammunition, generally not used for large caliber cannons, is termed "fixed ammunition" wherein all three of the component parts of the ammunition are fixed together. An example of the last named type is a rifle or a machine gun shell.

Ammunition supplying systems are well known wherein a large caliber cannon is mounted on a gun carriage. The barrel of the cannon is controllable in elevation on the carriage and the carriage is controllable in azimuth. Such a cannon is seen in the disclosure of the Girouard et al U.S. Pat. No. 3,218,930. This disclosure also relates to an ammunition handling system wherein stationary magazines provide both a projectile and a propellant charge to a hoist which lifts the projectile and charge together up to a carrier. The carrier receives the projectile and charge together and rotates to the azimuth position of the gun carriage. When the carrier reaches the gun azimuth position, the projectile and charge, referred to as a round hereinafter, is received from the carrier by a cradle on the gun carriage which is rotated about the gun support trunnion upwardly to a position such that the round is adjacent the rear of the gun and the cradle axis is parallel to the axis of the gun bore. The round is transferred from the cradle to a transfer tray and the tray is then swung downwardly to a position which is coaxial with the bore of the gun. The round is then rammed into the breech to complete the transfer from the magazine to the gun breech.

Various aspects of an open breech automatic rocket launcher are disclosed in U.S. Pat. Nos. 3,625,107 and 3,625,108 to Smith et al, U.S. Pat. No. 3,625,109 to Cornelison, and U.S. Pat. No. 3,625,110 to Cornelison et al. A vertically disposed magazine carries a stack of rocket rounds which gravitate to the bottom of the magazine. A star wheel arrangement brings the lowermost rocket round into a tray which is aligned with a revolver chamber, and a hydraulic ram transfers the round from the tray into the revolver chamber. The chamber is then revolved into alignment with a rocket firing tube in which the rocket is ignite and from which the rocket is propelled. The preferred embodiment discloses a four chamber revolving mechanism wherein two of the chambers which are displaced by 180°, are loaded simultaneously and the other two chambers which are also displaced by 180°, are fired simultaneously. Thus, as two live rocket rounds are aligned with the rocket firing tubes, two empty chambers are presented to be loaded by the rocket rounds dropped into the trays from the magazines.

U.S. Pat. No. 3,122,967 to Johnson et al discloses a system for delivering semi-fixed rounds of ammunition from a stationary magazine to the breech of a large caliber gun movable in azimuth and elevation. The magazines are drum type holders for projectiles and propellant charges which deliver a projectile and a propellant charge together to a lower hoist. The lower hoist lifts the round to a movable carrier. The carrier is caused to rotate about the gun azimuth axis and to deliver the round to an upper hoist. The upper hoist rotates with the gun carriage and delivers the round to a swinging cradle which carries the round to a position where it is delivered to a transfer tray. The tray moves the round into axial alignment with the bore of the gun and a ram is utilized to insert the round into the gun breech.

SUMMARY OF THE INVENTION

The invention disclosed herein relates to a system which provides rapid transfer of rounds of ammunition to a breech of a large caliber cannon which is controllable in both azimuth and elevation positions. Means mounted in fixed azimuthal relation with the cannon is provided for storing an array of ammunition rounds with the storing means being non-movable with the cannon in elevation. A support tray is provided which receives the ammunition rounds from the array and means is provided for moving the support tray from a receiving position which is adjacent to the storing means to a loading position which is adjacent to the breech of the cannon. Means is provided for transferring the ammunition rounds from the storage means to the support tray when the tray is in the receiving position. Means is also provided for loading ammunition rounds into the breech from the support tray when the tray is disposed in the loading position. A control is provided for sequentially actuating the storage means, the transfer means, the means for moving the support tray and the means for loading ammunition into the breech to thereby deliver a series of ammunition rounds from the stored array to the breech.

In the preferred embodiment of the invention a cradle arm is mounted on the elevation axis of the cannon and is free to rotate about the elevation axis. A round receiving tray is disposed for pivotal movement on the cradle arm, and means is provided for driving the tray pivotally between the receiving position and a position in a plane which includes the loading axis and which is perpendicular to the cannon elevation axis. A mechanism is provided for driving the cradle arm rotationally between elevation positions from which the tray may be pivoted to be aligned with the loading axis and with the receiving position.

BRIEF DESCRIPTION OF THE DRAWINGS

FIG. 8 is a side elevation view of the cradle arm and the transfer tray of the present invention.

FIG. 10 is a perspective view of a rammer pawl and actuating mechanism of the present invention.

FIG. 11 is an enlarged section taken along the line 11—11 of FIG. 8.

FIG. 18 is a hydraulic schematic of the rammer pawl drive of the present invention.

FIG. 19 is a block diagram of the control provided for the present invention.

DESCRIPTION OF THE PREFERRED EMBODIMENT

Figure 1:
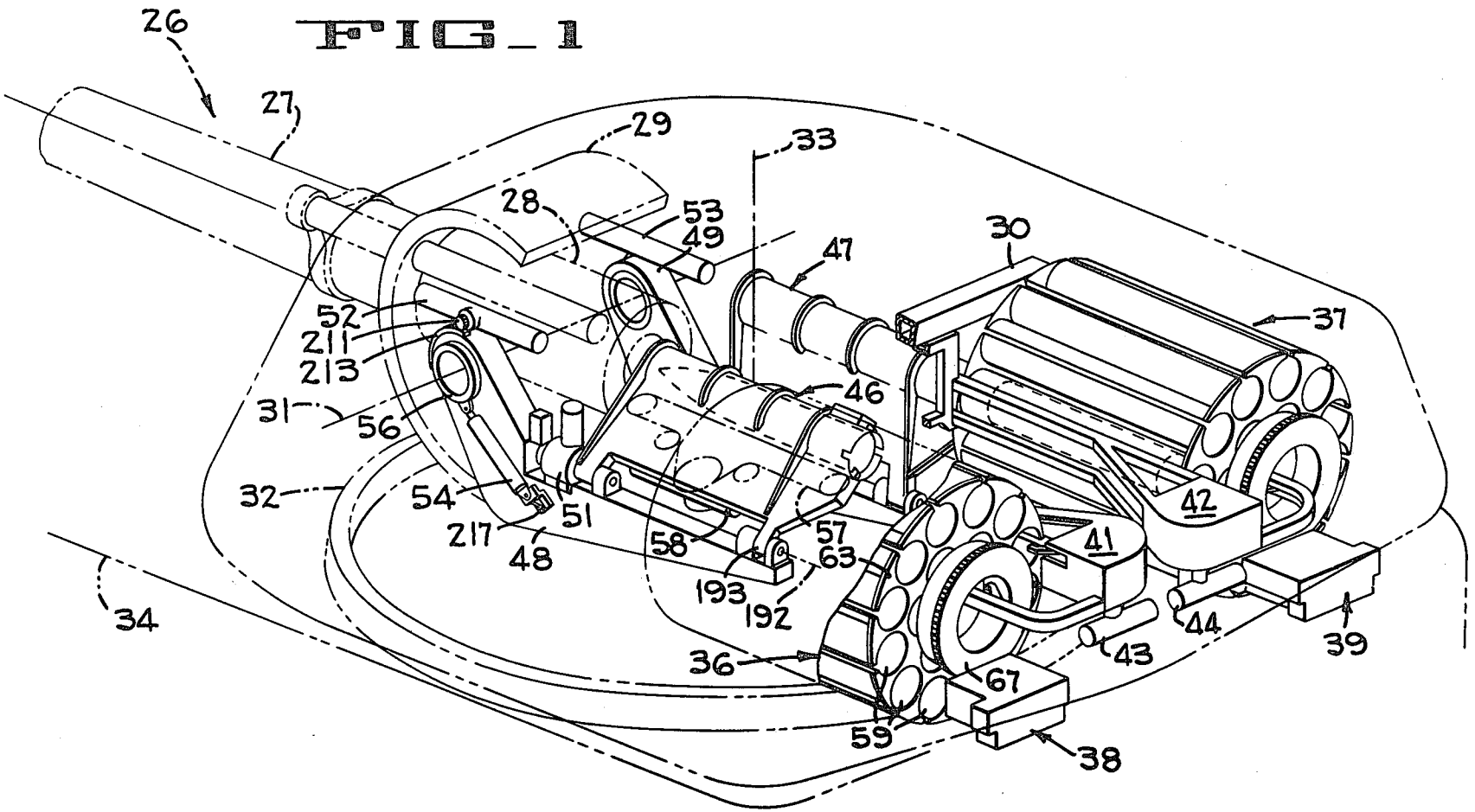
FIG. 1 is a perspective view of the ammunition handling system of the present invention.

With reference to FIG. 1 of the drawings a large caliber cannon is shown in phantom line generally at 26 having a forward extending gun tube 27 and a conventional breech 28 at the rear end of the gun tube. An arcuate ballistic shield 29 is shown as a part of the cannon, all of which is mounted to rotate about a trunnion or elevation axis 31 on a gun carriage framework 30 (partially broken away for clarity). The carriage is mounted for rotational movement on a circular track 32, also shown in phantom line, by bearing supports such as those known as Conrad bearings. The cannon 26 may therefore be moved in azimuth about an azimuth axis shown at 33. The track is affixed to a stable undersurface 34 such as the deck of the ship or the frame of a mobile armored vehicle.

The foregoing is conventional, forming no part of this invention, and will not be described in greater detail as it is well known to those of skill in this art. Included on the gun carriage, and therefore movable therewith, is a projectile storage drum 36 (partially broken away for clarity) and a propellant charge storge drum 37 (FIG. 1). A drum indexing drive 38 is provided for the drum 36 and an indexing drive 39 is provided for the drum 37. The indexing drives move their respective drums to predetermined angular positions about the axes of the drums. Also mounted to the carriage framework 30 and operating in cooperation with the drums is a loader chain assembly 41 for the drum 36 and another loader chain assembly 42 for the drum 37. Associated with chain assembly 41 is a hydraulic drive cylinder 43 and associated with chain assembly 42 is a hydraulic drive assembly 44. The loader chain assemblies are provided to remove projectiles and propellant charges from their respective storage drums and place them into a projectile transfer tray 46 and a propellant charge transfer tray 47 respectively. The transfer trays are pivotally mounted to a projectile cradle arm 48 and a propellant charge cradle arm 49 respectively so that they may be swung between positions to receive the projectiles and propellant charges from the drum and a position aligned with the axis of the breech 28. FIG. 1 shows the tray 46 aligned with the breech loading axis and the tray 47 aligned with a receiving position at the propellant charge drum 37. A hydraulic drive assembly 51 is seen in FIG. 1 for driving the projectile transfer tray 46 between the aforementioned breech loading and receiving positions. A similar hydraulic drive mechanism is provided for the transfer tray 47, but is not shown in FIG. 1.

A hydraulic drive assembly 52 is mounted on the carriage 30 and is used to drive the cradle arm 48 about the elevation axis 31. A similar hydraulic drive 53 is mounted on the carriage the opposite side of the breech 28 and performs the function of driving the propellant charge cradle arm 49 about the elevation axis. A damping and cradle arm position indication cylinder 54 is shown disposed between a breech trunnion 56 and the projectile cradle arm 48. A similar damping cylinder is provided for the propellant charge cradle arm 49 although it is not seen in the view of FIG. 1. A rammer chain 57, shown by hidden lines in FIG. 1, is mounted on the projectile transfer tray 46 and is driven by a hydraulic drive assembly 58 also mounted on the transfer tray. Similar structure, though not shown in FIG. 1, is present on the propellant charge transfer tray 47. The rammer chains serve to unload rounds from the trays into the breech.

It may therefore be seen that ammunition component stored in the storage drums 36 and 37 are indexed to a receiving position for the trays 46 and 47 by the index drives 38 and 39. The ammunition components are moved from the drums into the transfer trays by the loader chains 41 and 42, and the loaded transfer trays are thereafter taken to the appropriate gun tube elevation by the cradle arms 48 and 49 as driven by the drives 52 and 53 respectively. The transfer trays are then driven in sequence to the loading axis for the breech 28 by the drive 51 and by a similar drive for the tray 47. The ammunition components are thereafter moved from the trays and projected into the breech opening by action of the rammer chains 57 as driven by the hydraulic drives 58, it being realized that a similar rammer chain and drive is provided for the transfer tray 47 as is shown for the transfer tray 46.

MECHANICAL SUBSYSTEMS

Figure 2:
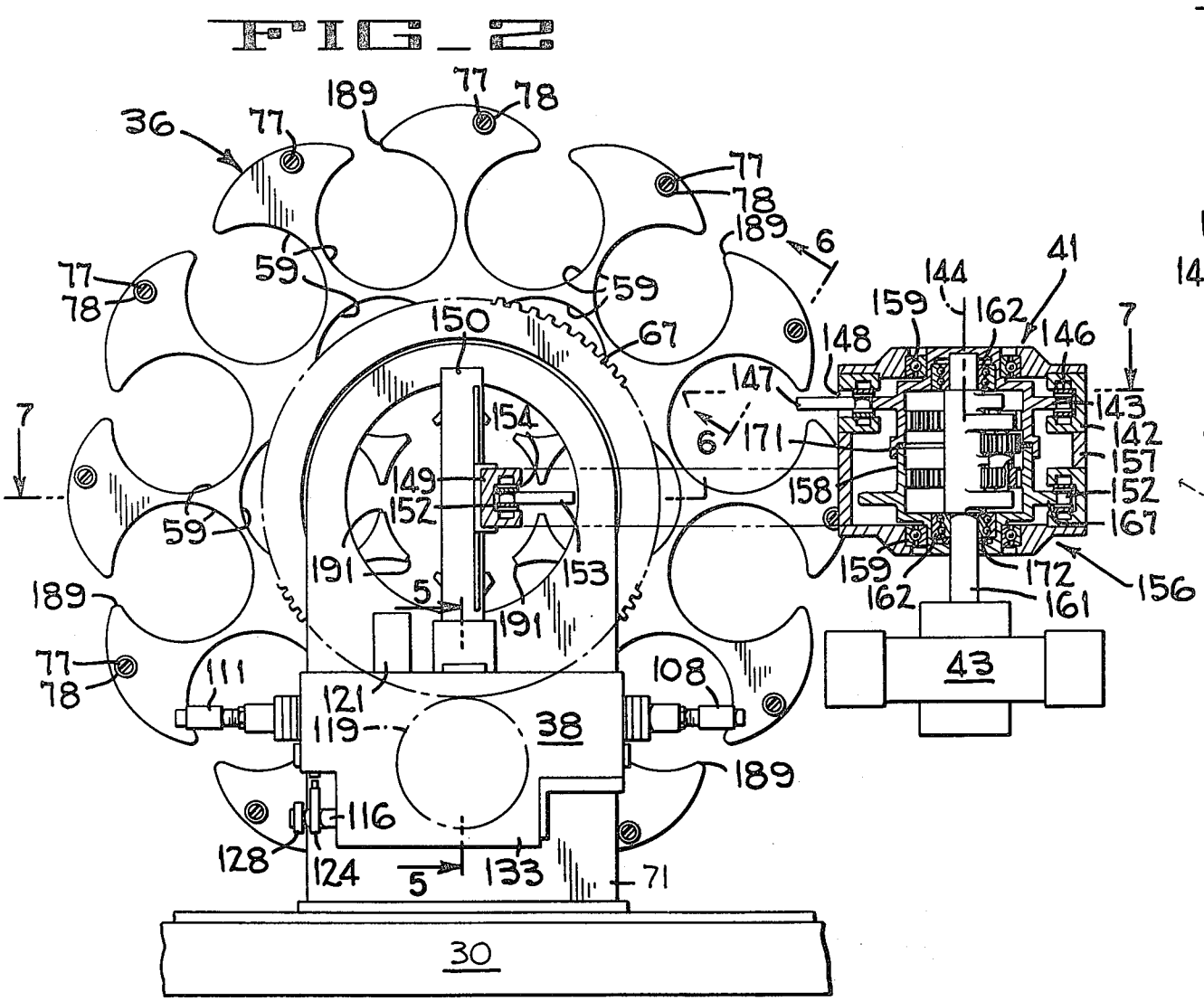
FIG. 2 is a rear elevation view partially in section of an ammunition storage drum and a loader chain drive of the present invention.
Figure 7:
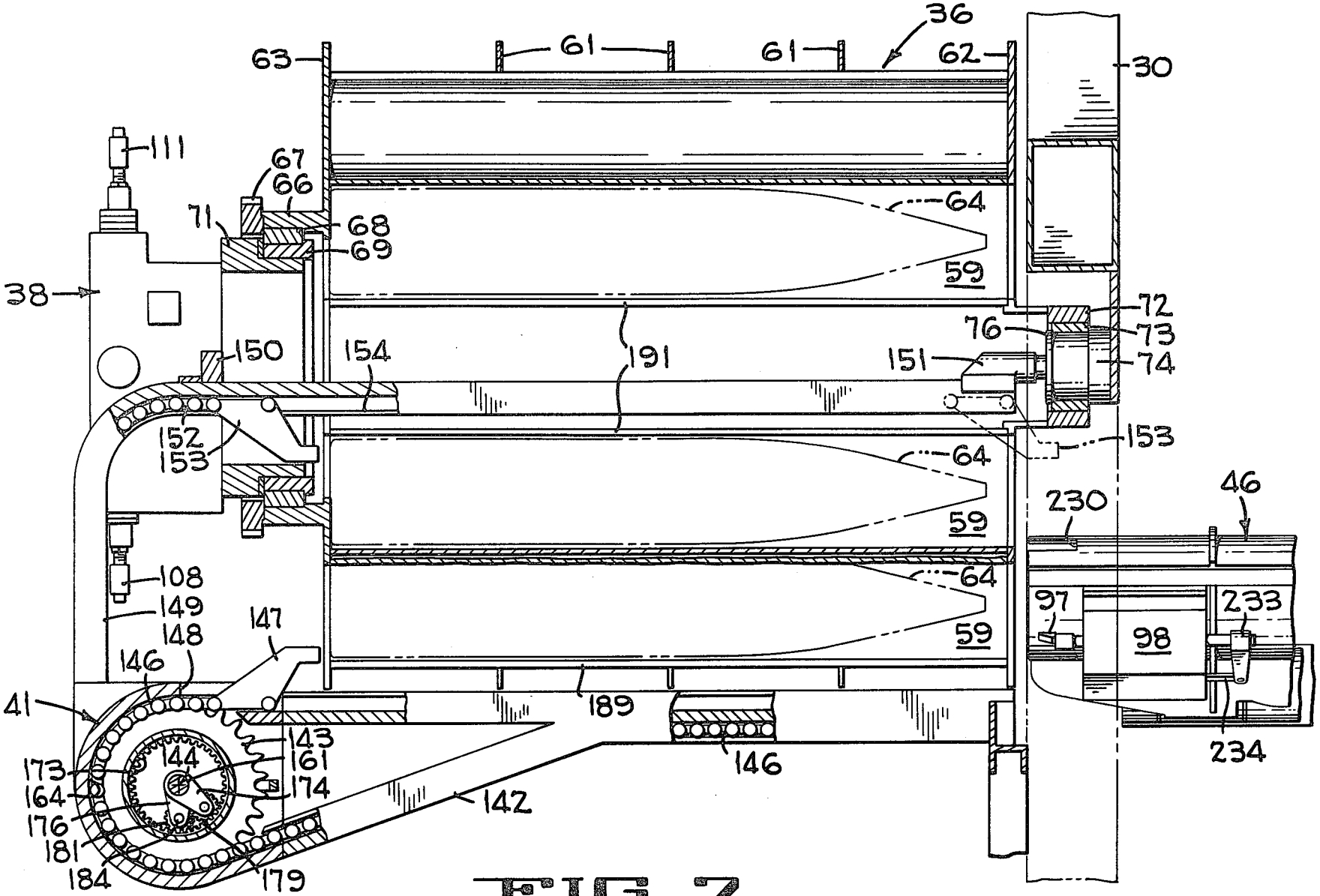
FIG. 7 is an enlarged section taken along the line 7—7 of FIG. 2.

FIG. 2 shows the rear of the projectile storage drum 36 looking forward toward the breech 28 of the gun. For the purposes of this disclosure, the projectile handling portion of the system only will be described as the propellant charge handling portion of the system is substantially a mirror image structurally. The storage drum 36 has a plurality of storage sleeves or chambers 59 therein which are arranged in two circular patterns, as shown. The outer circular array of chambers is twelve in number and the inner array numbers six. The drum 36 is mounted on the gun carriage 30 for rotating movement thereon, as best seen in FIG. 7. The drum 36 has a plurality of reinforcing segments 61 (FIG. 7) on the drum periphery. A forward end wall 62 and a rearward end wall 63 on the drum have openings thereon aligned with the sleeves 59. The sleeves may be seen to be adapted to hold projectiles shown in phantom line at 64. The rear wall 63 has a boss 66 extending therefrom to which is attached a drum indexing gear 67. The inner surface of the boss 66 carries a bearing retainer 68 which engages and retains a rear drum bearing 69 therein. A rear drum pivot 71 is attached to the carriage 30 and has a stepped outer cylindrical surface which engages the inner surface of the bearing 69. The forward wall 62 of the drum also has a boss 72 formed thereon which has an inner periphery formed to accept a forward drum bearing 73 for the drum 36. The inner surface of the bearing 73 is picked up by a shoulder stub shaft 74 which extends from the carriage 30. A bearing retainer 76 is attached to the end of the stub shaft for the purpose of capturing the bearing 73 between the end of the stub shaft and the shoulder thereon. Drum 36 may therefore be seen (FIG. 7) to be capable of rotating on the bearings 69 and 73 relative to the gun carriage framework 30.

Figure 6:
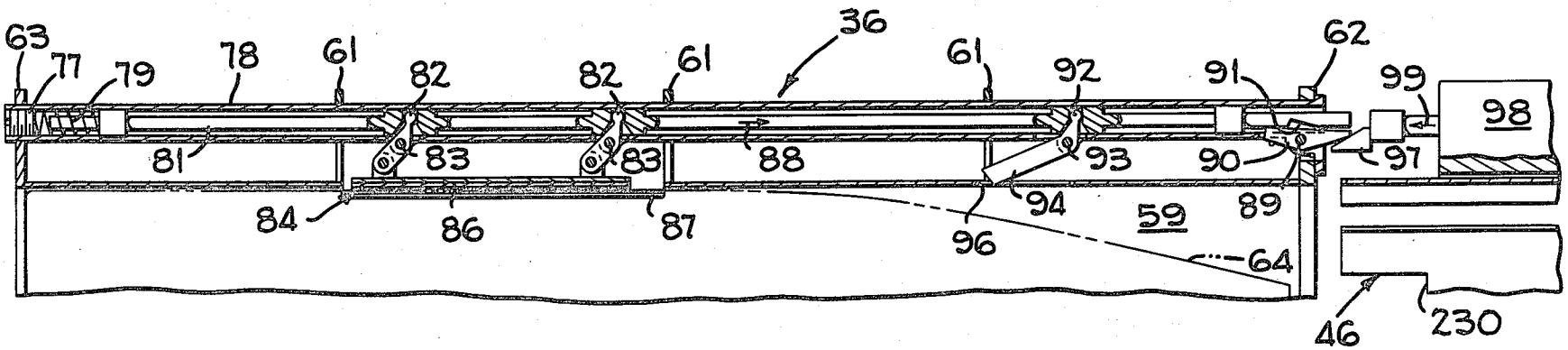
FIG. 6 is an enlarged section taken along the line 6—6 of FIG. 2.

The projectiles 64 after being loaded into the chambers 59 within the drum 36 must be held securely within the chambers until such time as they are selected to be removed. FIG. 6 is a partial section through the periphery of the drum 36. As seen in FIG. 2, the section of FIG. 6 is taken through a slotted screw 77 which also appears in FIG. 6 at the left side thereof. The screw 77 engages internal threads within a tube 78 which extends between the forward and rear walls 62 and 63 of the drum 36. The tube 78 is further supported between the end walls of the drum by the reinforcing segments 61 as seen in FIG. 6. The slotted screw 77 may be adjusted longitudinally on the internal threads within the tube 78 bearing against one end of a compression coil spring 79. The other end of the coil spring bears against a rod 81 within the hollow tube which is movable longitudinally therewithin. The rod 81 engages a pair of levers 82 at mid-points therealong. The levers extend through openings in the wall of the tube 78 and are pivoted at pivot points 83 on the tube. The levers 82 actuate a parallelogram linkage shown generally at 84 which has a stabilizing shoe 86 on one side thereof. There is an opening 87 in the wall of each of the chambers 59 which is in registration with the stabilizing shoe 86 and through which the shoe may extend. It may be seen that longitudinal movement of the rod 81 within the tube 78 moves the stabilizing shoe 86 in a radial direction relative to the chamber 59. Since the rod 81 is spring loaded in the direction of the arrow 88 in FIG. 6, the stabilizing shoe is normally moved radially outward so that it does not contact the surface of a projectile 64 within the chamber.

FIG. 6 also shows a latch member 90 attached to the forward wall 62 at a pivot 89. The latch member 90 is urged in a clockwise direction (as shown in FIG. 6) by a torsion spring (not shown). The end of the movable rod 81 which is proximate to the latch member has a detent 91 therein for receiving one end of the latch member. As a result, when the movable rod is pushed in a direction to compress the spring 79, the latch member 90 is urged by the torsion spring to enter the detent 91 and retain the rod against the compressed spring 79. The stabilizing shoe 86 is thereby moved radially inward to contact the surface of a projectile 64 within the chamber 59 and hold it firmly within the chamber.

As also seen in FIG. 6, the movement of the rod 81 acts against a third lever 92 which passes through the wall of the tube 78 and is mounted on the tube at a pivot point 93. The lever 92 actuates an arm 94 which is retracted as shown in FIG. 6 when the latching member 90 is out of the detent 91 and the rod 81 has been urged by the spring 79 in the direction of the arrow 88. However, when the latch is allowed to move into the detent 91 when the rod 81 is forced in a direction counter to the arrow 88, the arm 94 is extended and passes through an opening 96 in the wall of the chamber 59 to contact the ogive of the projectile 64 thereby assisting in securely holding the projectile 64 within the chamber 59. The rods 81 are unlatched during loading of projectiles into the chambers and are thereafter forced against the compression springs 79 until the latch members 90 engage the detents 91. As further shown in FIG. 6, the latch member 90 of each projectile holding mechanism is released by engagement with an unlatching pawl 97. The unlatching pawl is attached to the piston in a hydraulically actuated unlatching cylinder 98 so that when the piston is urged hydraulically to move in the direction of the arrow 99, the mechanism for holding a projectile within a chamber is released.

Figure 4:
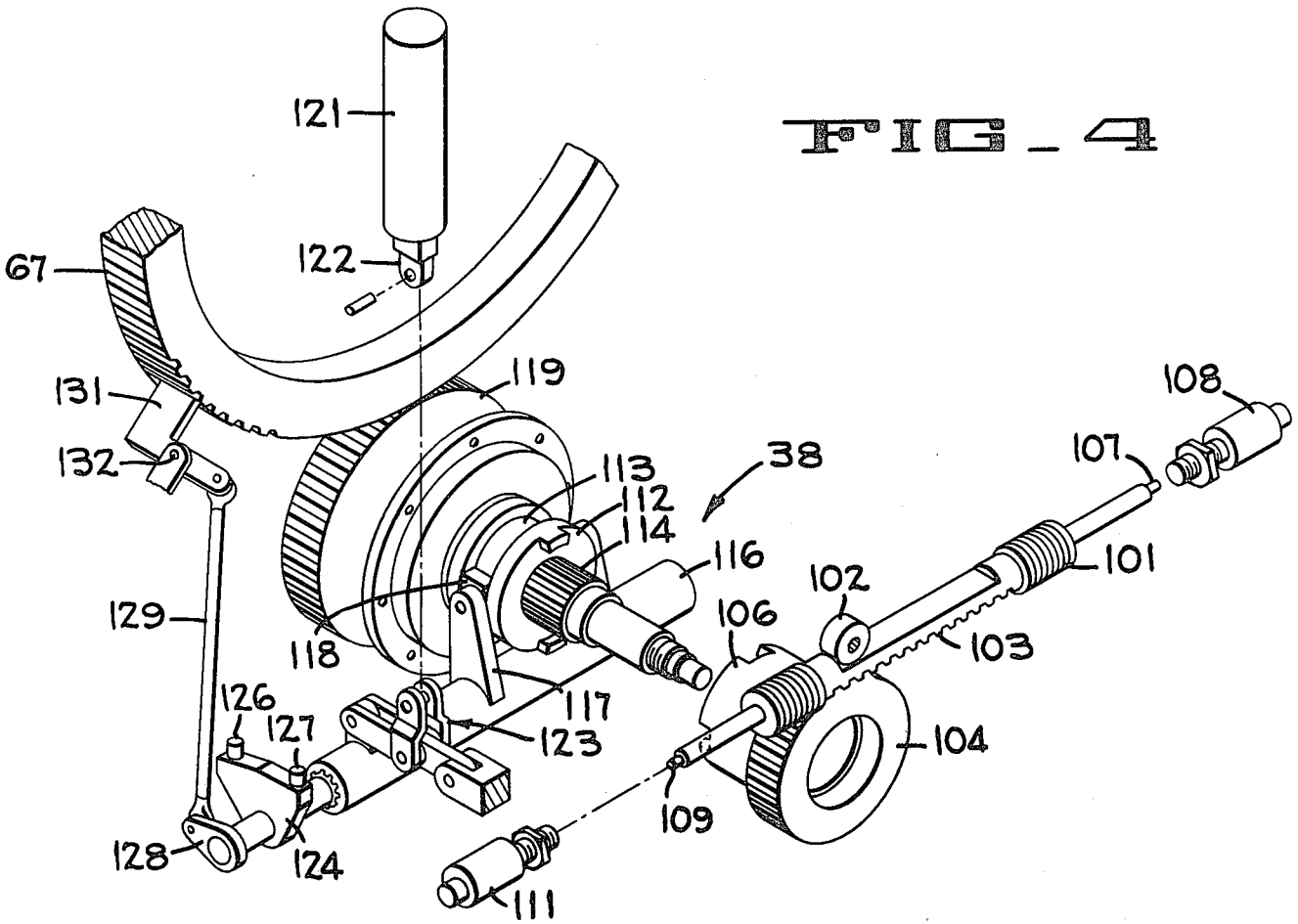
FIG. 4 is an exploded perspective view of an indexing drive for the ammunition storage drum of the present invention.

Turning now to the mechanism which indexes the ammunition storage drum 36, reference is made to FIG. 4 wherein an exploded view of the drum index drive 38 is shown. The storage drum is preferably driven in one direction only and the drive 38 therefore includes a mechanism for transferring the drive torque therethrough in one direction only. A hydraulically actuated piston 101 has a backup roller 102 in pressure contact with one side of the piston. A rack 103 is formed on the other side of the piston. The rack is positioned in engagement with a pinion gear 104 which is attached to and rotates with a notched clutch member 106. A small magnet 107 is attached to one end of the piston 101 so that when the piston is in the position shown in FIG. 4, the magnet will be adjacent to a proximity switch 108. When the magnet is adjacent to the proximity switch, the switch is in one state, whereas when the magnet is distant from the switch, it is in another state. A second small magnet 109 is seen on the opposite end of the piston 101 which functions in like fashion with a second proximity switch 111. Thus, an indication of piston position is provided by the switches.

A dog clutch member 112, having a peripheral groove 113 therearound, is mounted on a splined shaft 114. The dog clutch member is disposed for axial motion on the splines of the shaft. The clutch member 112 is moved axially on the splines by the rotation of an engage/disengage shaft 116 which has a radial arm 117 extending therefrom. A block 118 is pivotally mounted at the outer end of the arm 117 and is formed to fit into the groove 113 on the dog clutch member. When the shaft 116 is rotated through an arc in a clockwise direction, as seen in FIG. 4, the dog clutch member will move toward and engage with the notched clutch member 106, and rotation of the pinion gear 104 induced by actuation of the piston 101 will be transmitted through the splined shaft 114 to a drum drive gear 119. The drive gear is engaged with the drum index gear 67 mounted on the drum 36 so that when the drive gear 119 is rotated, the drum is indexed to a new rotational position.

The manner in which the shaft 116 is caused to rotate through an appropriate arc is accomplished through the use of an engage/disengage hydraulic actuator 121 having an arm 122 extending therefrom which is selectively extended or retracted hydraulically. The arm 122 is connected to an expanding linkage 123 which is pivotally connected at one end to a point on the periphery of the shaft 116 and is pivotally connected at the other end to the housing for the drum index drive 38. The linkage 123 pivots approximately mid-way of its length at which point it is connected to the end of the arm 122. Retraction of the arm 122 will foreshorten the linkage 123, causing the arm 117 to rotate clockwise, as seen in FIG. 4, and to thereby engage the dog clutch 112 with the notched clutch member 106. In this condition, rotation imparted to the pinion 104 by movement of the hydraulic piston 101 will be transmitted through the drum index drive 38 to the drum index gear 67 and the drum will be turned. Conversely, extension of the arm 122 will cause the engage/disengage shaft 116 to rotate through an arc in a counterclockwise direction, thereby disengaging the clutch members. In this condition movement of the hydraulic piston 101 will cause the pinion to rotate, but will not transmit rotational torque through the index drive to the drum index gear 67.

Attached to the end of the engage/disengage shaft 116 is a fixture 124 in which are mounted a pair of magnets 126 and 127 (FIG. 4). The magnets are associated with proximity switches 251 and 252 (shown in FIG. 13) which are similar to switches 108 and 111 so that when the clutch members are engaged, the switch associated with magnet 126 will be actuated and when they are disengaged, the switch associated with magnet 127 will be actuated. Also attached to the end of the shaft 116 is a drum lock actuating arm 128 which has pivotally attached thereto a drum lock actuation rod 129. A drum lock member 131 is pivotally attached to the other end of the drum lock rod and is also pivotally attached to the gun carriage 30 at a pivot point 132. It may be seen that when the engage/disengage cylinder 121 urges the arm 122 to extend, thereby disengaging the clutch members in the drum index drive 38, the drum lock member 131 is placed in firm engagement with the drum index gear 67. Alternatively, when the arm 122 is retracted, the drum lock member is pivoted to a position out of engagement with the teeth of the drum index gear. Thus, with the clutch members of the drum index drive engaged, the drum index gear is unlocked and the drum may be indexed by the drive, and with the clutch members disengaged the drum index gear is locked and the drum is fixed in angular position.

Figure 5:
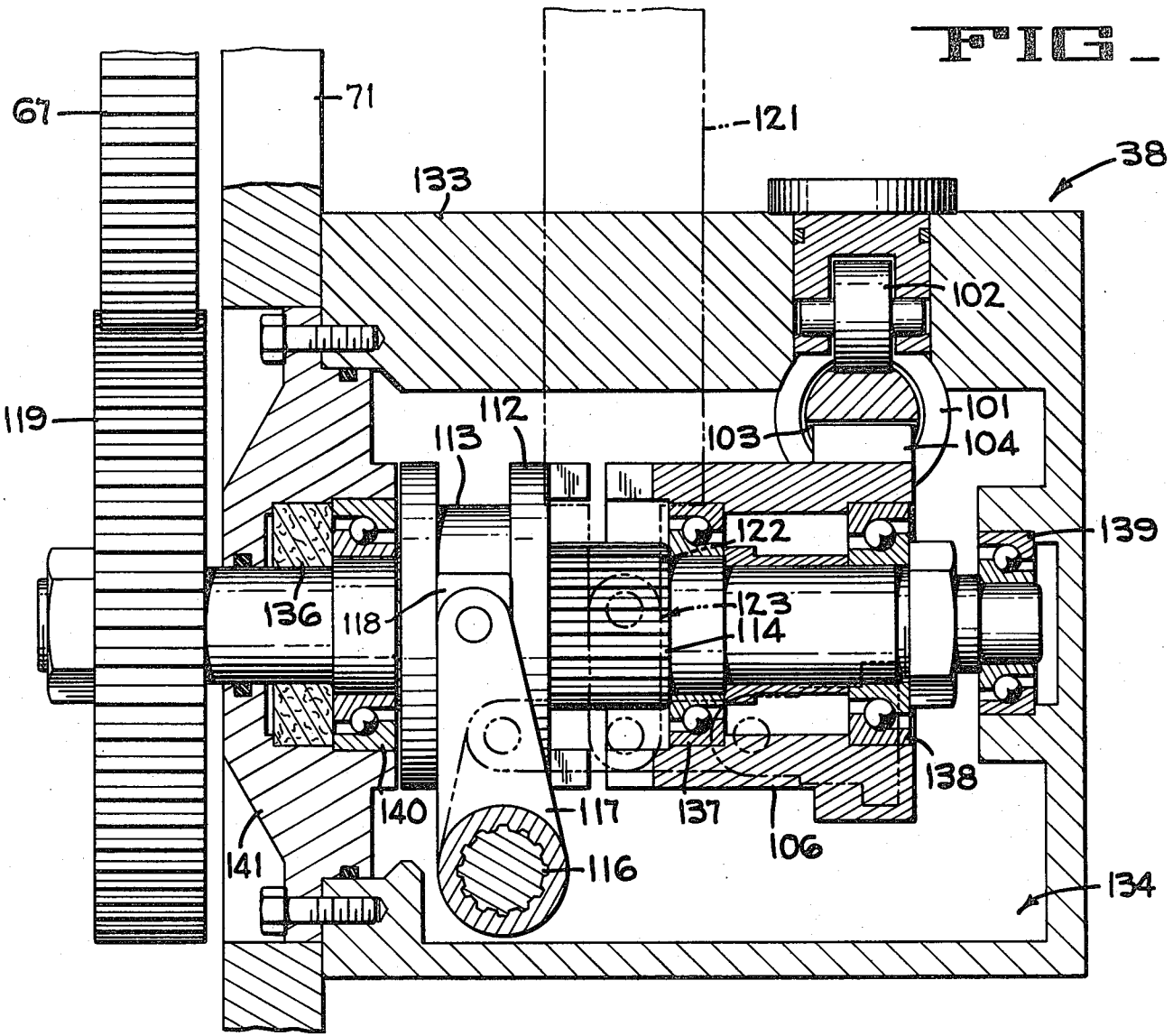
FIG. 5 is an enlarged section taken along the lines 5—5 of FIG. 2.

Referring to FIG. 5, the actual physical arrangements of the components in the drum index drive of FIG. 4 are shown. A housing 133 encloses the torque transfer train and defines a chamber 134, in a preferred embodiment, which is normally filled with oil. The housing contains a number of static oil seals which seal appropriate housing covers, etc. A dynamic oil seal 136 is shown surrounding the output end of the splined shaft 114. The rack 103 on the hydraulically driven piston 101 is seen engaged on one side by the back-up roller 102, which is firmly mounted in the housing, and on the other side by the teeth of the pinion gear 104. The pintion gear is attached to the notched clutch member 106 which has a hollow cylindrical form the internal surface of which engages the outer races of a pair of bearings 137 and 138. The inner races of the bearings 137 and 138 engage the periphery of the splined shaft 114 which extends therethrough. The output end of the splined shaft 114 is supported in the housing by a bearing 140 situated next to the seal 136. The shaft 114 is supported in the housing at the end opposite the output end by another bearing 139. The engage/disengage shaft 116 is supported at opposite ends by bearings which are mounted in the wall of the housing 133. The end of the shaft 116 that carries the magnet holding fixture 124 extends through a dynamic seal in the housing so that the magnets 126 and 127 are external to the housing and located near the previously mentioned pair of proximity switches. The housing includes a removable sealed cover 141 surrounding the output end of the splined shaft 114.

Referring to FIG. 4 of the drawings, an operating sequence description for the drum index drive 38 will be undertaken. It will be apparent to those of skill in this art that an appropriate stroke distance of the piston 101 together with appropriate numbers of teeth and pitch diameters on the pinion gear 104, drum drive gear 119 and drum index gear 67 will provide for a desired angular movement of the storage drum 36 to place a projectile in proper position to be received by the transfer tray 46 when positioned at a receiving position for either the inner or the outer circular array of chambers 59. Presuming for purposes of illustration that the drum index gear 67 is to be rotated in a clock wise direction, as seen in FIG. 4, when indexing chambers within the storage drum to a position for transfer of projectiles, it may be seen that magnet 107 is initially positioned close to proximity switch 108 thereby actuating the switch. Actuation of this switch causes the pressure which has driven the piston 101 into the position as shown in FIG. 4 to be shut off. When a control signal is subsequently transmitted to the system which corresponds to an initiation of a drum indexing cycle, pressure is caused to be transmitted to the engage/disengage cylinder 121 which causes the arm 122 to retract within the cylinder, thereby drawing the linkage 123 upwardly at the center and causing engage/disengage shaft 116 to rotate clockwise thus engaging the dog clutch member 112 with the notched clutch member 106. The lock 131 which rotationally fixes the drum index gear 67 is disengaged by the clockwise rotation of the shaft 116 through the linkage hereinbefore described. The small magnet 126 is thereby positioned close to the "engage" proximity switch (251 in FIG. 13) actuating the switch. The signal from this switch actuation enables pressure to be delivered to the side of the piston 101 which drives the piston so that the magnet 109 is brought proximate to the proximity switch 111. This may be seen to drive the pinion gear 104 in a counterclockwise direction (FIG. 4). This rotary motion is transferred through the clutch members to the drum drive gear 119. When the drum drive gear rotates counterclockwise its engagement with the drum index gear 67 is seen to drive the latter gear in a clockwise direction. Actuation of the switch 111 provides a signal which removes the pressure from the right hand side of the piston 101 as seen in FIG. 4 and which enables pressure to be delivered to the engage/disengage cylinder 121 which extends the arm 122 to thereby straighten the expandable linkage 123. The linkage motion causes the shaft 116 to rotate in a counterclockwise direction (FIGS. 4 or 5) thereby moving the arm 117 counterclockwise and the dog clutch member 112 axially along the splined shaft 114 to a position out of engagement with the notched clutch member 106. This motion brings the magnet 127 close to a proximity switch (252 in FIG. 13) which enables pressure to be applied against the end of cylinder 101 to drive the cylinder back to the position shown in FIG. 4. Since the clutch members are disengaged the pinion gear 104 is driven rotationally by passage of the rack 103 but the drum drive gear and drum index gear are not driven. Further, the drum lock member 131 is caused to engage the teeth of the index gear 67 when the shaft 116 rotates counterclockwise. Thus the index gear is not only disengaged from the drum drive while the drive piston 101 transits through the return stroke, but it is positively locked in angular position. The cycle is complete now as magnet 107 once again comes into a position adjacent proximity switch 108 thereby terminating the pressure which has driven the cylinder 101 to the right in FIG. 4 and enabling pressure to the cylinder 121 which when delivered will retract the arm 122 and engage the clutch members for the next storage drum indexing cycle.

The structure which performs the function of transferring the projectiles 64 from the projectile storage drum 36 is best described by first referring to FIG. 7 of the drawings. As stated hereinbefore, since the structure for transferring the propellant charges from the charge storage drum 37 is substantially the same, only the projectile transfer will be described. An outer loader chain track 142 is shown attached at one end to the gun carriage framework 30 and at the other end surrounding an outer loader chain drive sprocket 143 which is supported to rotate about an axis 144. A loader chain 146 is carried within the track 142 and is engaged by the teeth on the drive sprocket 143. A loader pawl 147 is attached to and moves with the loader chain 146. The loader pawl extends through a slot 148 formed in the track from the sprocket to the end of the track attached to the gun carriage. An inner chamber loader chain track 149 is also seen in FIG. 7 having one end secured to a bracket 151 attached to the end of the shouldered stub shaft 74. The inner chamber track passes around the rotation axis 144, and the other end is fastened by means of a support member 150 to the rear drum pivot 71 at a point adjacent to the rearward end of the drum. An inner chamber loader chain 152 is disposed within the inner track having a pawl 153 attached thereto which travels with the inner chain. A slot 154 is formed in the inner chamber loader chain track and the pawl 153 passes therethrough so that it may travel from approximately the position shown in solid line in FIG. 7 to the position shown in phantom line. The travel of the pawl 147 in the slot in the outer chamber track is approximately the same as the travel of the inner chamber pawl 153.

As seen in FIG. 7 the pawls 147 and 153 are positioned so that they lie behind the rearward end of projectiles 64 positioned in ones of the outer and inner rings of chambers 59 respectively. With reference to FIG. 2 there are slots 189 in the outer surface of the projectile storage drum 36 communicating with each chamber 59. The pawl 147 extends through the one slot 189 which is aligned with the outer chamber loader chain track slot 148 to contact the projectile within the outer ring in the storage drum. There are also slots 191 at the inner surface of the projectile storage drum 36 in communication with each of the inner chambers 59. The pawl 153 passes through the one slot 191 which is aligned with the inner chamber loader chain track slot 154 to contact a projectile within an inner chamber 59. It follows then that if either the outer chamber loader chain 146 or the inner chamber loader chain 152 is driven so as to push one of the loader pawls along one of the slots 148 and 154, a projectile will be ejected by the pawl from a chamber 59 through one of the openings aligned therewith in the front wall 62. After being advanced to eject a projectile 64 from one of the chambers 59 and the pawl is retracted to the positions shown in solid line in FIG. 7.

Figure 3:
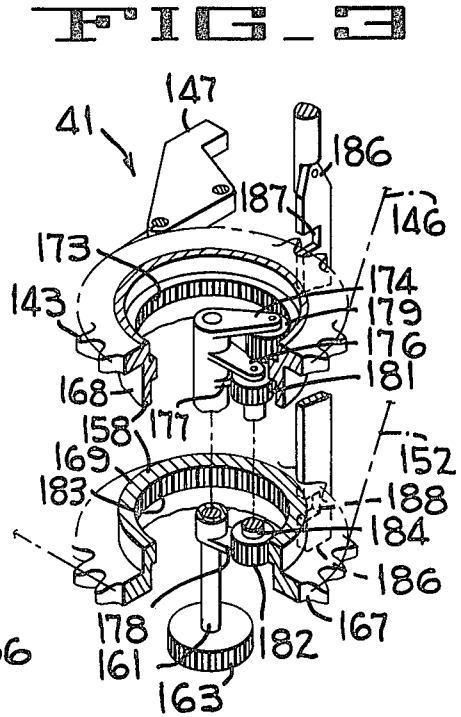
FIG. 3 is an exploded perspective view of the loader chain drive of FIG. 2.

The mechanism for advancing and retracting the loader chain pawls is best shown with references to FIGS. 2 and 3. The loader chain assembly 41 includes a loader chain gear assembly 156 to which the outer and inner chamber chain tracks 142 nd 149 respectively are attached. The gear assembly has an outer housing 157 which is fixed to the gun carriage. Within the outer housing is an inner housing 158 which is rotatable with respect to the outer housing on a pair of supporting end bearings 159. A loader chain drive shaft 161 extends through the inner housing along the axis 144 and is mounted therein by means of bearings 162 positioned at opposite ends of the inner housing. The loader chain drive shaft has a pinion gear 163 (FIG. 3) attached to that end of the shaft which extends from the inner housing 158. The pinion gear is coupled to a piston driven rack within the hydraulic drive cylinder 43 in the same fashion as that illustrated for the pinion gear 104 of the drum index drive 38 in FIG. 4.

Figure 14:
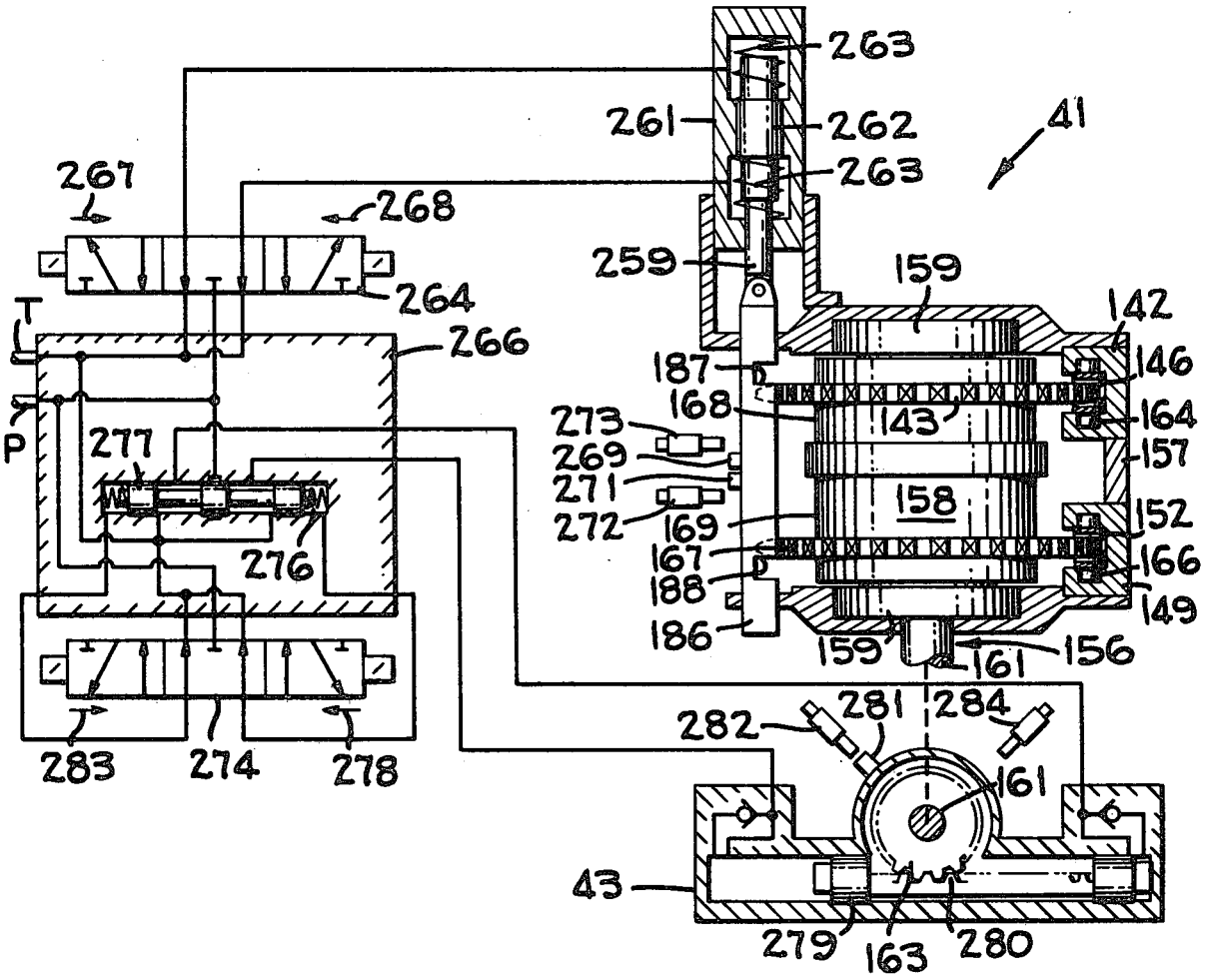
FIG. 14 is a hydraulic schematic of the loader chain drive of the present invention.

The inner housing 158 may therefore be seen to be capable of rotation about the axis 144 within the outer housing 157 (FIG. 2). The shaft 161 is also capable of rotation about the axis 144 within the inner housing. The outer housing wall has an annular passage 164 (FIG. 7) extending through an arc slightly over 180° which is in communication at each end with the outer chamber loader chain track 142. The loader chain 146 therefore extends through the chain track and the annular passage and is brought into contact with the teeth on the sprocket 143 as mentioned hereinbefore. The outer housing also has a second annular passage 166 (see FIG. 14) extending through an arc slightly more than 90° which is in communication with the inner chamber loader chain track 149. The inner chamber loader chain 152 therefore extends through the inner chain track and the annular passage 166. An inner chamber loader chain drive sprocket 167 is disposed on the inner housing 158 to pick up the inner chamber loader chain 152 within the annular passage 166 (FIG. 14).

The inner housing 158 is a sealed housing containing oil therewithin for lubrication of gears contained in the housing which will be hereinafter described. An upper portion of the housing is shown in FIG. 2 consisting of the outer chamber loader chain drive sprocket 143 which is formed so that it has a hollow shaft on one end surrounded by the inner race of the upper bearing 159 at the outer periphery and the outer race of the upper bearing 162 at the inner periphery. The outer end of the drive sprocket 143 consists of a depending skirt 168 (FIG. 3). The lower portion of the inner housing 158 consists of the inner chamber loader chain drive sprocket 167 which has a skirt 169 extending upwardly and fitting into the inner diameter of the skirt 168. An oil seal 171 (FIG. 2) is disposed between the skirts 168 and 169 so that oil contained within the chamber formed by the inner housing 158 is retained therein while the sprockets 143 and 167 rotate relative to one another. A hollow shaft extends downwardly from the sprocket 167. The inner race of the lower bearing 159 supports the hollow shaft at its outer periphery and the outer race of the lower bearing 162 supports the hollow shaft at its inner periphery. The shaft 161 extends between and through the bearings 162. An oil seal 172 is also provided between the inner housing 158 and the shaft 161 where the shaft exits from the housing.

An exploded perspective view of the inner housing 158 with some of the structure removed to provide clarity is shown in FIG. 3. The outer chamber drive sprocket 143 is the inner bearing portion which engages the upper bearings 162 and 159, and a segment of the sprocket is removed so that a view into the inside of the inner housing is provided. A ring gear 173 is formed on the inner wall of the sprocket 143. The shaft 161 has four radially extending arms thereon 174, 176, 177 and 178. An idler gear 179 is retained between the arms 174 and 177 and is free to rotate about an axis parallel to axis 144 and extending between the arms. The idler gear is meshed with the ring gear 173. A double planetary gear is contained between the arms 176 and 178 having an upper planetary gear 181 and a lower planetary gear 182. The idler gear 179 is sufficiently long axially to that the upper planetary gear 191 is meshed therewith. The lower planetary gear 182 is meshed with a lower ring gear 183 formed on the inner periphery of the inner chamber loader chain drive sprocket 167. The upper and lower planetary gears are seen to rotate together on a comman shaft 184 about an axis parallel to axis 144.

A slide 186 (FIGS. 3 and 14) is provided which moves parallel to the axis 144. A pair of notches 187 and 188 are formed therein (FIG. 3). Slide 186 is axially adjustable so that the notch 187 can be positioned to allow the teeth on the sprocket 143 to pass therethrough while simultaneously engaging and locking the sprocket 167 with a portion of the slide being inserted between two of the teeth on the last named sprocket. The slide is also adjustable in position so as to lock the outer chamber loader chain drive sprocket 143 rotationally by positioning the slide between two of the teeth of the sprocket while at the same time positioning the lower notch 188 so that the teeth of the inner chamber loader chain drive sprocket 167 pass therethrough allowing the latter sprocket to rotate about the axis 144.

With reference once again to FIGS. 2 and 3, the manner in which the slide 186 is positioned longitudinally to determine which of the loader chains 146 or 152 is to be driven to thereby transfer a projectile 64 from either an outer chamber or an inner chamber respectively will be explained. With the slide 186 in a lowered position as shown in FIG. 3 so that the teeth in the sprocket 143 pass through the notch 187 and so that the lower portion of the slide 186 is lodged between two teeth of sprocket 167, the drive sprocket for the inner chamber loader chain 152 is locked. The rack in the hydraulic drive cylinder 43 is driven past the pinion gear 163 to impart a clockwise rotation to the shaft 161 as seen in FIG. 3. The lower planet gear 182 "walks" around the ring gear 183 thereby turning the lower planet gear in a counterclockwise direction. The upper planet gear 181 is therefore also turned in a counterclockwise direction through the connecting shaft 184. The upper planet 181, being meshed with the idler gear 179, drives the idler gear 179 in a clockwise direction. The idler gear being meshed with the ring gear 173 therefore drives the outer chamber loader chain drive sprocket 143 in a clockwise direction. This may be seen to cause the outer chamber loader chain 146 to advance in the outer chamber loader chain track 142. The pawl 147 is brought into contact with the rear surface of one of the projectiles 64, and as the pawl advances through the slot 189 the projectile is ejected from the chamber 59 into the projectile transfer tray 46 when the tray is positioned in the outer ring receiving position. When the rack within the hydraulic drive cylinder 43 is returned the pinion 163 and the shaft 161 are rotated in a counterclockwise direction and the gearing retracts the loader chain 146 to return the pawl 147 to the position shown in solid lines in FIG. 7.

When the slide 186 is elevated so that the teeth on the sprocket 167 pass through the notch 188 in the slide, the slide is positioned between a pair of teeth on the periphery of the sprocket 143 locking it rotationally. In this situation when the rack within the drive cylinder 43 is driven in a direction to turn the pinion gear 163 in a clockwise direction the idler gear 179 is caused to walk around the ring gear 173 on the inside of the locked sprocket 143. The idler is thus rotated in a counterclockwise direction thereby causing the upper planet gear 181 with which it is meshed to rotate in a clockwise direction. The upper planet gear drives the lower planet gear 182 in a clockwise direction through the connecting shaft 184. The rotation of the lower planet gear meshed with the lower ring gear 183 causes the lower ring gear to also move in a clockwise direction. Clockwise rotation of the inner chamber loader chain drive sprocket 167 drives the inner chamber loader chain 152 in a direction to advance the pawl 153 through the slot 191 to the position shown in phantom line in FIG. 7. The advance of the pawl 153 due to the extension of the loader chain 152 causes the pawl 153 to contact the rear side of a projectile 64 in an inner chamber 59 thereby transferring it from the chamber into the projectile transfer tray 46 positioned at an inner ring receiving position. When the rack within the hydraulic cylinder 43 is caused to return to its original position, thereby driving the pinion 163 in a counterclockwise direction, the loader chain 152 is retracted, as is evident from the foregoing explanation, and the pawl 153 is returned to the position shown in solid lines in FIG. 7.

As mentioned hereinbefore the transfer trays 46 and 47 are rotatable on the cradle arms 48 and 49. Tray 46, for example, is rotatable about an axis 192 as best seen in FIGS. 1 and 8. A hinge point and hydraulic slip joint 193 (FIG. 8) is provided which transfers hydraulic pressure from the cradle arm 48 to the projectile transfer tray 46. A shaft 194 is supported on bearings within a housing 196 which is mounted on the cradle arm. The shaft is fixed to the tray 46 as it passes through a tongue 197 depending from the tray. The end of the shaft 194 is supported for rotation within another tongue 198 extending from the cradle arm 48. The opposite end of the shaft 194 has mounted thereto a tray position detent member 199 which rotates with the shaft. Also fixed on the shaft is a pinion gear 201 shown by dashed lines in FIG. 8 and located within the housing 196. A hydraulic transfer tray drive cylinder 202 is shown which is part of the hydraulic drive assembly 51 for the projectile transfer tray 46 and which contains a piston and a rack gear similar to the arrangement of the piston 101 and the rack gear 103 of FIG. 4. The rack is engaged with the pinion gear 201 to drive the tray 46 rotationally about the axis 192.

Figures 9, 12:
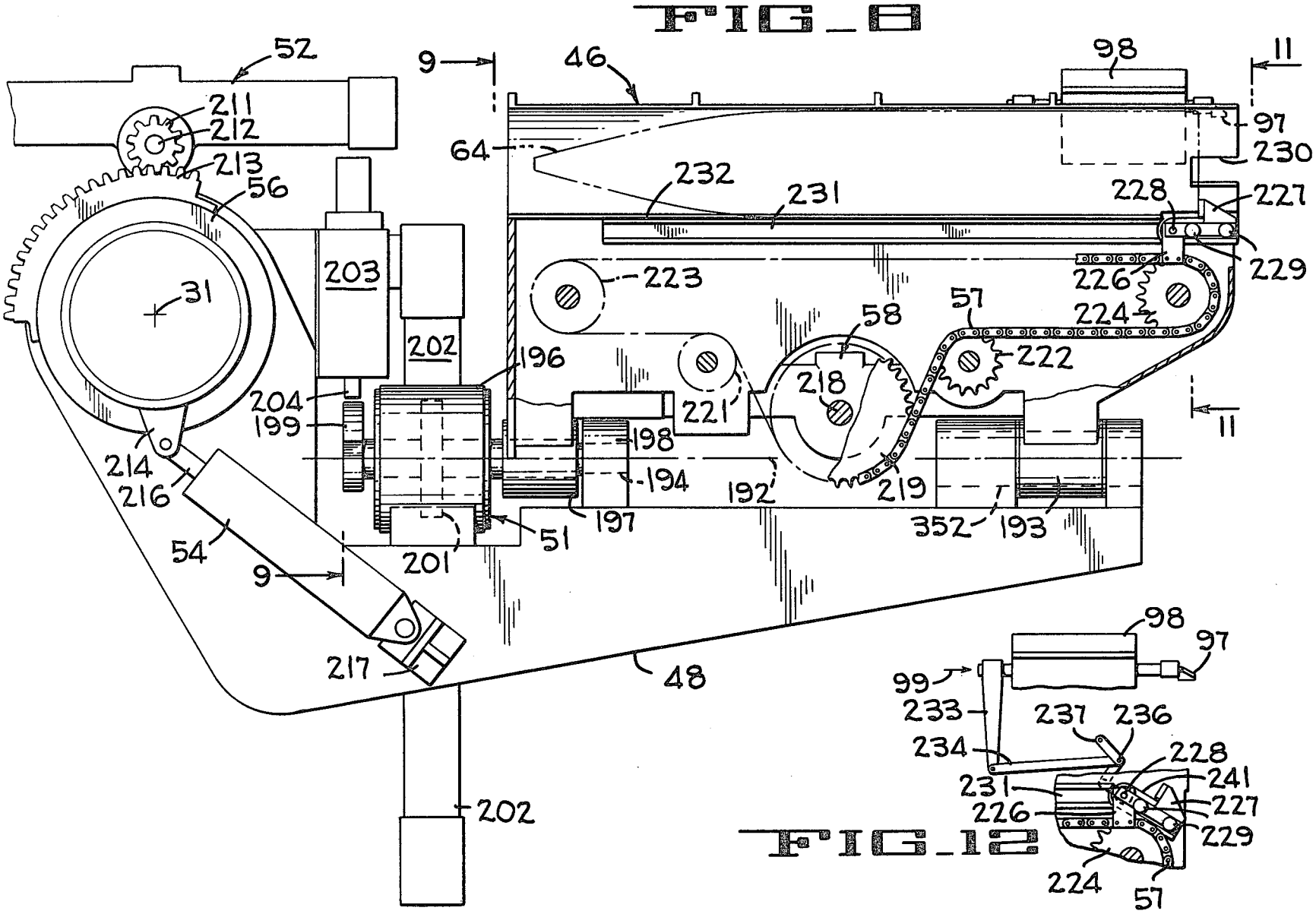
FIG. 9 is a section taken along the line 9—9 of FIG. 8 with alternate positions of the transfer tray being shown in phantom lines.
FIG. 12 is a side elevation of the rammer pawl of the present invention.

A hydraulic tray lock cylinder 203 is seen in FIG. 8 mounted on the cradle arm 46. The lock cylinder operates to selectively extend and retract a tray position latch 204. In the view of FIG. 9 looking rearwardly toward the projectile transfer tray 46, the tray position latch is shown in the retracted position. The tray is driven to an angular position relative to the cradle arm by appropriate application of hydraulic pressure to one end or the other of the piston in the transfer tray drive cylinder 202 and the lock cylinder is hydraulically actuated when the desired tray angular position is approached to extend the tray position latch 204 to engage the tray position detent member 199. FIG. 9 shows the tray 46 in solid lines aligned with a receiving position to accept a projectile 64 from one of the chambers 59 in the outer ring of chambers in the projectile storage drum 36. When the tray is to be retained in this position the position latch 204 is extended by the lock cylinder 203 to engage an outer position detent 206 in the detent chamber 199. With the projectile transfer tray shown in the position indicated at 46' in FIG. 9 the position latch 204 is extended at engage a shoulder 207. In this position the tray is aligned with a chamber 59 in the inner ring of chambers within the projectile storage drum. With the transfer tray positioned at 46" of FIG. 9 the position latch is extended to engage a shoulder 209 on the detent member 199 thereby locking the tray in a loading position with the axis of the tray aligned with the breech 28 of the cannon when the cradle arm 48 is at the elevation of the gun tube 27. The transfer tray 46 may therefore be seen to swing about the tray axis 192 (FIG. 8) to assume one of the two receiving positions; 46 at the outer ring of chambers and 46' at the inner ring of chambers 59; and a loading position 46" (FIG. 9) wherein the tray axis is in a plane which is orthogonal to the elevation axis 31 (FIG. 1) and which includes the loading axis for projectiles and propellant charges extending centrally through the breech 28 (FIG. 1).

Clearly, if the gun tube 27 and the breech 28 are driven to some position away from zero elevation, a projectile received at one of the positions 46 or 46' in FIG. 9 will not be aligned with the loading axis through the breech 28 if merely rotated about the tray pivot axis 192 to the position 46". While the axis through the transfer tray at position 46" will be in the plane which is orthogonal to the elevation axis 31 and which includes the loading axis through the breech it will not be aligned with the loading axis. Since such alignment is necessary before the round can be rammed into the breech, the cradle arm 48 must be driven about the elevation axis 31 to bring the axis of the transfer tray to the same elevation as the gun tube and the breech. To accomplish the proper positioning of the transfer tray 46 so that it is aligned with the loading axis the cradle arm 48 is driven by the cradle arm hydraulic drive assembly 52 which includes a drive gear 211 as seen in FIG. 8. The cradle arm drive assembly 52 is mounted on the gun carriage framework 30 as hereinbefore described and contains a hydraulically driven piston similar to piston 101 in FIG. 4. A rack and pinion arrangement similar to the rack and pinion 103 and 104 of FIG. 4 is provided in the drive assembly 52 and a shaft 212 is coupled to the drive gear 211. The drive gear engages a sector gear 213 mounted on the cradle arm 48 so that as the gear rotates the cradle arm will be moved angularly about the elevation axis 31. The breech trunnion 56, which is fixed to the gun tube 27, has a trunnion arm 214 extending therefrom. The damping and position indication cylinder 54 has an arm 216 extending therefrom which is pivotally connected to the end of the arm 214. The opposite end of the cylinder 54 is seen to be pivotally connected to the cradle arm 48 by means of a bracket 217. The damping end position indication cylinder 54 functions as the cradle arm is driven about the elevation axis 31, which function will be described in greater detail hereinafter.

FIG. 8 shows the location of the rammer chain hydraulic drive cylinder 58 on the tray 46. The drive 58 is similar to the piston type rack and pinion drum index drive 38 including components corresponding to the piston 101, rack 103 and pinion 104 shown in FIG. 4. The rammer chain drive pinion is mounted on an output shaft 218 which is coupled to a drive sprocket 219. A pair of idler sprockets 221 and 222 are mounted on the transfer tray 46. A guide sprocket 223 is mounted on the transfer tray at the forward end thereof and another guide sprocket 224 is mounted at the rearward end. The rammer chain 57 is routed around the drive sprocket 219, over the idler sprockets 221 and 222 and around the front and rear guide sprockets 223 and 224. A bracket 226 is attached to the rammer chain and is shown in FIG. 8 with the rammer chain drive in the retracted position. A rammer pawl 227 is pivotally attached by means of a pivot pin 228 to the bracket 226. The rammer pawl has four roller guides 229, two located on each side of the rammer pawl. The roller guides are disposed to travel in a track 231 which extends the major portion of the distance between the front and rear guide sprockets 223 and 224 for the rammer chain as seen in FIG. 8.

The rammer pawl 227 extends upwardly through a slot 232 in the lower portion of the projectile receiving passage of the transfer tray 46 as seen in FIG. 11. The projectile receiving passage of tray 46 has two short slots 230 in the rearward end. These slots allow the loader chain pawls 147 and 153 to advance into the tray for a short distance to properly position the projectiles just ahead of the rammer pawl. Thus, the rammer pawl 227 is disposed behind a projectile 64 contained within the transfer tray so that as the rammer chain 57 is driven to advance that section of the chain between the sprockets 224 and 223, the rammer pawl moves forwardly along the slot to eject the projectile from the front of the transfer tray into the breech.

FIG. 11 shows the unlatching cylinder 98 mounted on the transfer tray 46. The cylinder is mounted at the rearward end of the transfer tray as best shown in FIG. 8. The piston within cylinder 98 is selectively hydraulically extended thereby extending the unlatching pawl 97 in the direction of the arrow 99 (FIG. 6) so that a projectile 64 within a chamber 59 is released by the shoe 86 and the ogive securing arm 94 as described hereinbefore. With the extension of the unlatching pawl, linkage is concurrently actuated which is described with reference to FIG. 10. A depending arm 233 is attached to the cylinder piston also moving in the direction of the arrow 99 when the piston is extended. A drive link 234 connects the end of the arm 233 at a pivot point 236 with a fixed link 237 and a movable link 238. While the fixed link 237 may pivot about its upper pivot, the upper pivot may not translate. The lower end of the movable link 238 is pivotally connected to a depressing arm 239. The arm is attached to a rod 240 which is attached to a movable section 241 of the roller guide track 231. Another movable section 242 is located on the opposite side of the track 231. Both sections may therefore be rotated about an axis through the rod 240.

It may be seen that as the depending arm 233 moves in the direction of the arrow 99 upon actuation of the unlatching cylinder 98 the distance across the links 237 and 238 is foreshortened causing the depressing arm 239 to raise as seen in FIG. 10. Thus, the track section 241 is rotated in a counterclockwise direction as shown about the pivot pin 228 (see FIG. 12). The roller guides 229 being disposed within both track sections rotate about the pivot 228 together with track section 242, thereby depressing the rammer pawl 227 so that it is in an out of the way position as the projectile 64 is transferred from one of the chambers 59 into the transfer tray 46 by one of the loader chain pawls 147 or 153. The action of the linkage to provide depression of the rammer pawl when the unlatching cylinder 98 is actuated is shown in FIG. 12.

The projectiles 64 are literally thrown into the breech 28 when the tray 46 is aligned with the loading axis of the breech. For 155 millimeter projectiles a velocity of approximately twenty-two feet per second has been found to be appropriate for loading. The rammer pawl 227 is accelerated to such a velocity before being arrested. The propellant charges are also thrown into the breech behind the projectiles, but at a somewhat lesser velocity.

HYDRAULIC ACTUATORS

In the preferred embodiment the indexing of the magazine drums 36 and 37, actuation of the loader chains 146 and 152, driving of the transfer trays 46 and 47, positioning of the cradle arms 48 and 49, and driving of the rammer chains 57 are all accomplished hydraulically. Conventional hydraulic slip joints are used to transfer hydraulic pressure and return fluid from the deck 34 to the gun carriage 30, from the gas carriage to the gun tube 27 and breech 28, from the gun tube and breech to the cradle arms 48 and 49 and from the cradle arms to the transfer trays 46 and 47. The hydraulic slip joints will not be described in any detail since they are well within the knowledge of those with skill in the art.

Figure 13:
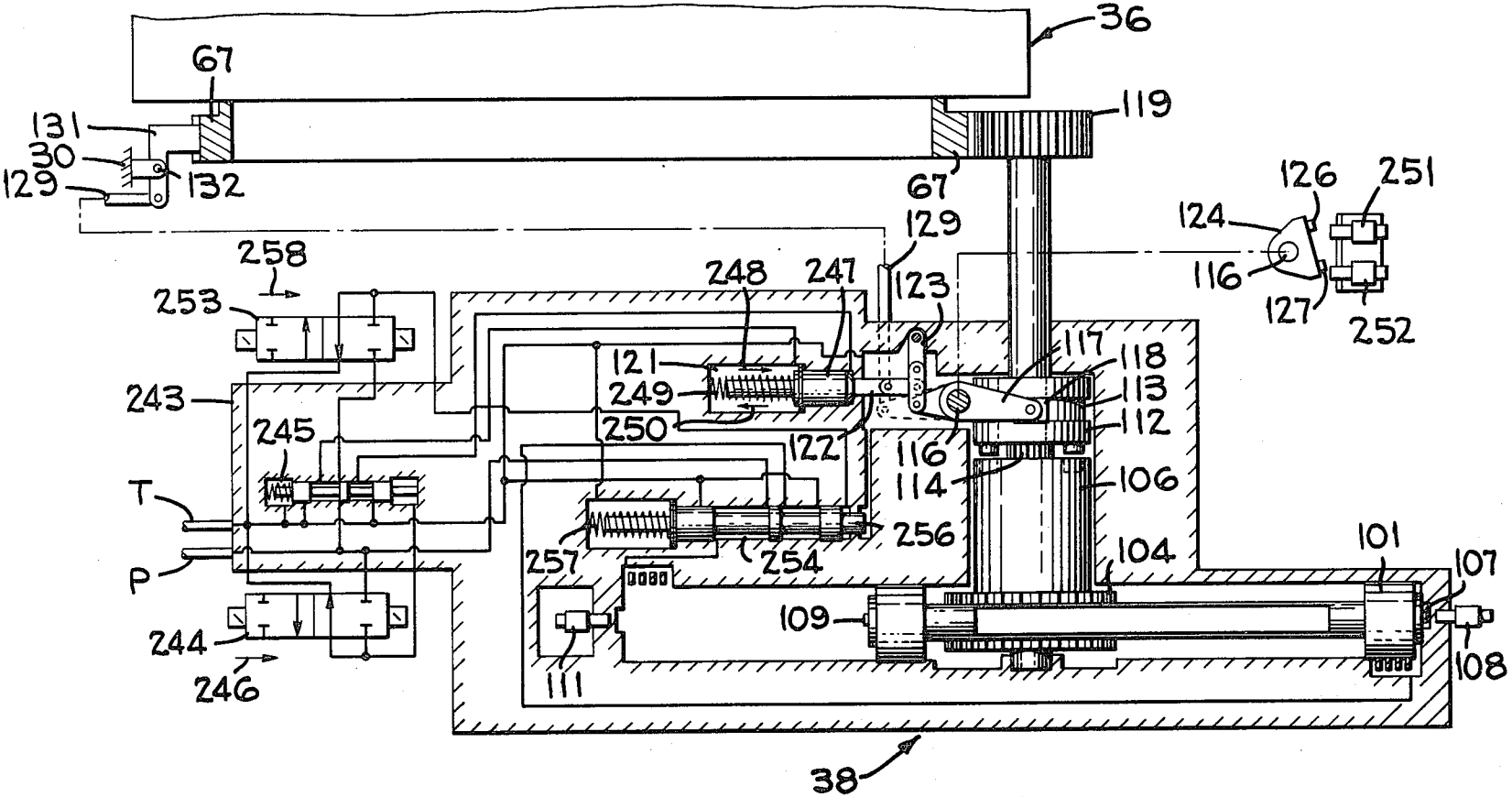
FIG. 13 is a hydraulic schematic of the ammunition drum drive of the present invention.

The actuation of the hydraulic drum indexing drives 38 and 39 for the projectile and propellant charge storage drums 36 and 37 will be described in conjunction with FIG. 13. A hydraulic pressure line P and a return line T to the hydraulic reservoir tank are shown coupled to a valve block 243. The valve block is shown as a part of the drum index drive 38 for the storage drum 36 in FIG. 13. A clutch engagement pilot valve 244 is shown in the deactuated condition. Actuation of the pilot valve 244 is generally accomplished by a solenoid movement of the valve in the direction of the arrow 246. In the deactuated position as shown it may be seen that the clutch engage/disengage cylinder 121 is pressurized through a hydraulic control valve 245 to move a piston 247 disposed therein in a direction providing clutch disengagement and as indicated by the arrow 248. The control valve 245 is spring loaded to the position shown in FIG. 13 until the piston therein is displaced by actuation of a pilot valve. The pressure in cylinder 121 is aided by a coiled spring 249 within the cylinder. It may be seen that with the piston 247 in the position shown in FIG. 13 the arm 122 attached to the piston is extended from the cylinder and the clutch members 112 and 106 are disengaged as hereinbefore described. At the same time the drum lock member 131 is caused to engage the teeth of the drum index gear 67 through the motion of the drum lock actuation rod 129 as also hereinbefore described. The magnet 127 on the holding fixture 124 is therefore in a position to actuate a clutch disengage proximity switch 252. When the clutch engagement pilot valve 244 is solenoid actuated to move the valve in the direction of the arrow 246 pressure is applied to the right end of the control valve 245 as seen in FIG. 13 to drive the valve member to the left as seen therein. Pressure may now be seen to be applied through the lines to the right side of the piston 247, and the piston is driven in the direction indicated by the arrow 250. This action of the piston retracts the arm 122 simultaneously causing the clutch members 112 and 106 to engage and the drum lock member 131 to disengage from the teeth of the index gear 67. The magnet holding fixture 124 rotates clockwise as seen in FIG. 13 thereby placing the magnet 126 proximate to a clutch engage proximity switch 251 and providing a switch output.

A drum index drive pilot valve 253 is shown in the deactuated condition in FIG. 13. With the pilot valve positioned as shown the right end of a control valve 254 is coupled to the return hydraulic line T (tank pressure) and a coil spring 257 in the valve drives a piston 256 contained therein to the right (FIG. 13). The pressure line P is thereby communicated through the control valve 254 to the left end of a cylinder contained in the drum index drive 38 in which the piston 101 is disposed for longitudinal movement. The right end of the cylinder is seen to be connected to the return hydraulic line through the control valve 254. With the drum drive in this condition the proximity switch 108 is adjacent to the magnet 107 on the end of the piston 101 and provides an output indicative of the piston position.

The pilot valve 253 is a solenoid actuated valve and is actuated in the direction of the arrow 258 (FIG. 13) when energized. When actuated the pilot valve 253 directs pressure to the valve 254 which moves the piston 256 therein against the coil spring 257. The pressure line which enters near the center of the valve 254 is thereby communicated with the adjacent line leading to the right end of the cylinder containing the piston 101. At the same time the left end of the cylinder is communicated with the tank or return line T through the valve 254. Consequently the piston 101 and the rack 103 are driven to the left as shown and the pinion gear 104 is rotated. When the piston has moved sufficiently to place the magnet 109 adjacent to the proximity switch 111, the switch provides an appropriate output. As hereinbefore described the movement of the piston 101 to the left in FIG. 13 occurs by actuation of pilot valve 253 when the clutch members 112 and 106 are engaged and the index gear 67 is unlocked to thereby turn the storage drum 36. It may be seen however that the direction of drive for the storage drum is dependent upon the sequence of the actuation of the pilot valves 244 and 253. If the pilot valve 244 is not actuated when the pilot valve 253 is actuated, then the left movement of the piston 101 would not index the storage drum 36. Complete flexibility of control is therefore provided whereby the sequencing of the pilot valve actuation dictates the direction in which the storage drum 36 is indexed.

The hydraulic circuits for the loader chain drives 41 and 42 are identical. Only the hydraulic schematic for the chain drive 41 is shown in FIG. 14. The locking slide 186 shown in FIG. 3 is depicted in FIG. 14 attached to the end of a piston arm 259 which extends through the end of a sprocket locking cylinder 261 and is attached to a piston 262 contained therein. The piston is spring loaded by coil springs 263 to a center or neutral position within the cylinder. As shown in FIG. 14 the slide 186 is in the neutral position engaging and locking both the outer and inner chamber loader chain drive sprockets 143 and 167. A sprocket unlocking pilot valve 264 is shown also in a neutral position so that tank return line T is communicated through a valve block 266 to both sides of the piston 262. Hydraulic pressure P is also brought into the valve block 266. When the pilot valve 264 is solenoid actuated in the direction of the arrow 267 hydraulic pressure is applied to the upper side of the piston 262 and the lower side is communicated with the hydraulic reservoir tank thereby driving the slide 186 downwardly until the notch 187 is aligned with the teeth on the outer chamber drive sprocket 143. It may be seen that the inner chamber drive sprocket 167 is still engaged by the slide 186. The outer chamber loader chain 146 may therefore be driven through the shaft 261 as hereinbefore described to eject a projectile 64 from a chamber 59 which has been indexed to align with the transfer tray positioned at the outer ring receiving position. It is clear from the foregoing that if the pilot valve 264 is driven in the direction of the arrow 268 the piston 262 will be moved upwardly within the cylinder 261 thereby aligning the notch 188 with the teeth on the inner chamber loader chain drive sprocket 167 while maintaining the sprocket 143 in a locked condition. It should also be noted in FIG. 14 that magnets 269 and 271 are disposed to move with the slide 186 so that when the loader chain drive sprocket 143 for the outer chambers is free to rotate the magnet 271 is adjacent to a proximity switch 272 to provide an outer chamber drive indication. In similar fashion when the slide 186 is caused to move so that the loader chain drive sprocket 167 for the inner chambers is free to rotate the magnet 269 is adjacent to a proximity switch 273 which provides an indication of inner chamber drive.

FIG. 14 also shows a loader chain pilot valve 274 which is in communication with the pressure and tank lines through the valve block 266. The valve block also contains a control valve 276 containing a piston 277 which is spring loaded to a neutral position as shown. With the pilot valve 274 in the position as shown in FIG. 14 both ends of the piston in the control valve are communicated with the tank line and the control valve remains neutrally located. With the pilot valve 274 solenoid actuated in the direction of arrow 278 pressure is applied to the control valve 276 to drive the piston 277 to a position causing pressure to be routed through the control valve to the left end of the hydraulic cylinder 43 as seen in FIG. 14. Consequently a piston 279 disposed within the cylinder contained in the drive 43 is driven to the position shown. A rack 280 on the piston 279 is meshed with the pinion gear 163 driving the pinion rotationally aand retracting either the loader chain 146 or 152 depending upon whether the inner or the outer loader chain is elected to be driven by the pilot valve 264 as described hereinbefore. A magnet 281 is attached to the structure rotated by the pinion gear 163. The magnet is moved into a position adjacent to a proximity switch 282 which provides a signal indicative of retracted loader chains.

When the pilot valve 274 is actuated in a direction indicated by the arrow 283 in FIG. 14 pressure is communicated with the left end of the piston 277 in the control valve 276. The piston is moved so that pressure is communicated through the control valve to the right end of the cylinder in the hydraulic drive 43 to drive the piston 279 and the rack 280 thereon to the left as seen in FIG. 14. The pinion gear 163 is rotated by the rack to extend whichever loader chain is unlocked by the actuation of the pilot valve 264. The magnet 281 is thereby moved until it is adjacent to a proximity switch 284 which provides a signal indicative of an extended loader chain. The usual appropriate relief valves and deceleration ports for the piston 279 as it approaches the end of the cylinder are shown in the hydraulic drive cylinder 43.

Figures 15, 16:
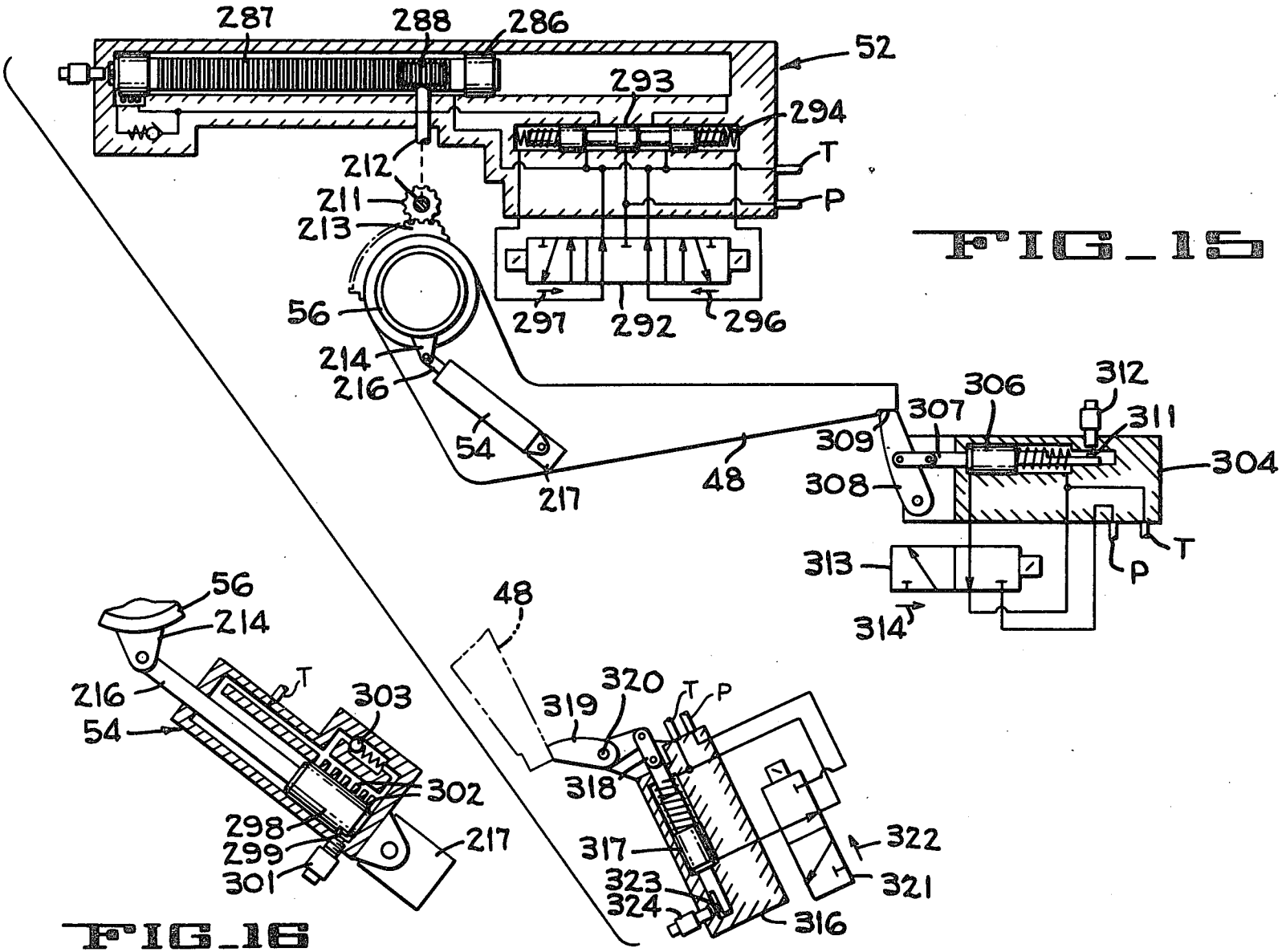
FIG. 15 is a hydraulic schematic of the cradle arm drive of the present invention.
FIG. 16 is a section of the cradle arm damping and position indication cylinder.

Turning now to FIG. 15 a hydraulic schematic is shown for driving and latching the cradle arm 48 between a position at which the projectile transfer tray 46 is in alignment with one of the chambers 59 in the storage drum 36 and a position with the tray in alignment with the loading axis through the breech 28. The hydraulic drive assembly 52 for the cradle arm 48 is shown containing a cylinder in which is disposed a piston 286 which moves longitudinally in the cylinder. A rack 287 is formed on the piston which is meshed with a pinion gear 288 fixed on the output shaft 212. The cradle arm drive gear 211 is meshed with the sector gear 213 and is fixed to the other end of the output shaft 212. A pressure line P and a return line T to the hydraulic tank are shown coupled to the cradle arm drive 52. A cradle arm position pilot valve 292 is shown in a neutral position wherein the tank line T is couple to both ends of a piston 293 which is spring urged to a neutral position within a control valve 294. When the pilot valve 292 is solenoid actuated in the direction of the arrow 296 pressure is directed against the piston 293 which moves the piston to route pressure through the control valve 294 to the right end of the piston 286. The piston is therefore urged into the position shown in FIG. 15 and the drive gear 211 drives the cradle arm 48 to 0° elevation. This is the cradle arm position from which the transfer trays are rotated into one of the receiving positions to receive ammunition components from the storage drums. With the pilot valve 292 solenoid actuated in the direction of the arrow 297 pressure is directed against the piston 293 in the control valve which sets the valve to communicate pressure with the left end of the piston 286. Piston 286 is thereby driven to the right within the drive assembly 52. The rack motion past the engaged pinion 288 is such as to turn the drive gear 211 in a direction to cause the cradle arm to move clockwise as seen in FIG. 15 and thereby lower the cradle arm.

As best seen in FIG. 16 a piston 298 is contained within the damping and position detection cylinder 54. The piston rod 216, as hereinbefore described, is attached to the trunnion arm 214 on the gun tube trunnion 56 and extends through the end wall of the cylinder 54. The cylinder is connected to the hydraulic reservoir through line T and piston position within the cylinder as shown in FIG. 16 is realized only when the cradle arm 48 is aligned with the gun tube 27. A magnet 299 is carried on the piston so that when the cradle arm is in alignment with the gun tube the magnet is adjacent to a proximity switch 301 which provides an indication of such alignment. The cylinder 54 is seen to have a pattern of apertures 302 at the end approached by the the cradle arm 48 is approaching alignment with the gun tube so that the cross section of the oil flow path is gradually decreased to thereby gradually decelerate the cradle arm. A check valve 303 is also provided so that movement of the piston 298 within the cylinder away from the end mounting the proximity switch (increasing the angle of the cradle arm) meets a lesser resistance from the hydraulic flow than movement of the piston in the opposite direction.

A zero elevation latch 304 is seen in FIG. 15 which operates to latch the cradle arm in position when it is oriented so that the transfer tray 46 may be rotated about axis 192 to the receiving, or projectile pickup, positions. The zero elevation latch contains a cylinder in which a piston 306 is disposed which is spring loaded to extend an arm 307 from the latch. The arm, when extended, pivotally places a latch member 308 in position to contact a detent 309 in the cradle arm 48 to thereby prevent the cradle arm from being lowered from the 0° elevation position. The piston 306 carries a magnet 311 which is disposed adjacent to a proximity switch 312 when the cradle arm is latched thereby providing an indication that the zero elevation latch is set. A pilot valve 313 is solenoid actuated in the direction of the arrow 314 to route pressure from a pressure line P to the left side of the piston 306 (FIG. 15) thereby driving the piston to the right, releasing the latch and changing the state of the output from the proximity switch 312. As soon as the solenoid actuating pilot valve is de-energized the left side of the piston 306 is communicated with the tank line T and the spring bearing against the piston returns it to the latch position.

A gun tube elevation latch 316 is also shown in FIG. 15. The gun tube elevation latch 316 is carried on the breech structure so that it moves in elevation with the gun tube and the breech. The latch 316 has a cylinder therein containing a piston 317 which is spring loaded toward a retracted position at the lower end of the cylinder as shown. An arm 318 extends through the end wall of the latch. A latching member 319, which is spring loaded in a clockwise direction by some means such as a torsion spring (not shown), is attached to the end of the arm 318 at a pivot 320. As the cradle arm 48 is lowered and as it passes by the upper curved surface of the latching member it depresses or rotates the latching members 319 against the torsion spring. After the cradle arm has passed the latching member the latching member springs into the position as shown in FIG. 15 contacting the upper side of the cradle arm and locking it in place at the gun tube elevation.

A solenoid actuated pilot valve 321 is shown in FIG. 15 with latch 316 in the latched position. When the pilot valve is actuated in the direction or the arrow 322 pressure is communicated with the lower side of the piston 317 forcing the arm 318 to extend thereby rotating the latch member 319 in a clockwise direction as shown and releasing the cradle arm 48 for travel back to the 0° elevation position. When the pilot valve is de-energized it returns to the position as shown in FIG. 15 communicating the lower end of the piston with the tank line T. A magnet 323 is carried on the piston 317 and is in a position which is adjacent to a proximity switch 324 when the piston is in the latched position. Thus, the proximity switch 324 provides a signal indicative of the state of the gun tube elevation latch; latched or unlatched.

Figure 17:
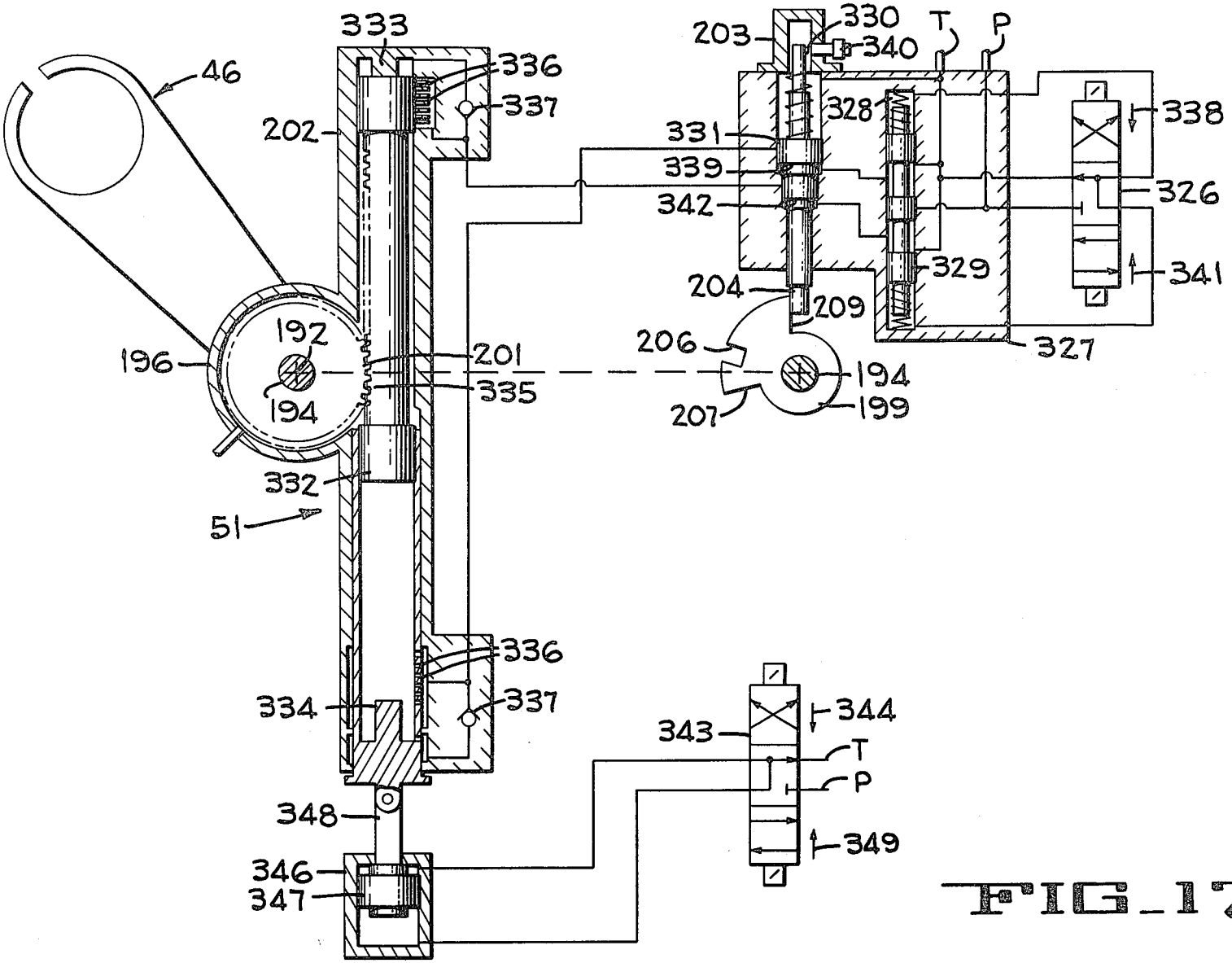
FIG. 17 is a hydraulic schematic of the transfer tray drive of the present invention.
Figure 16:
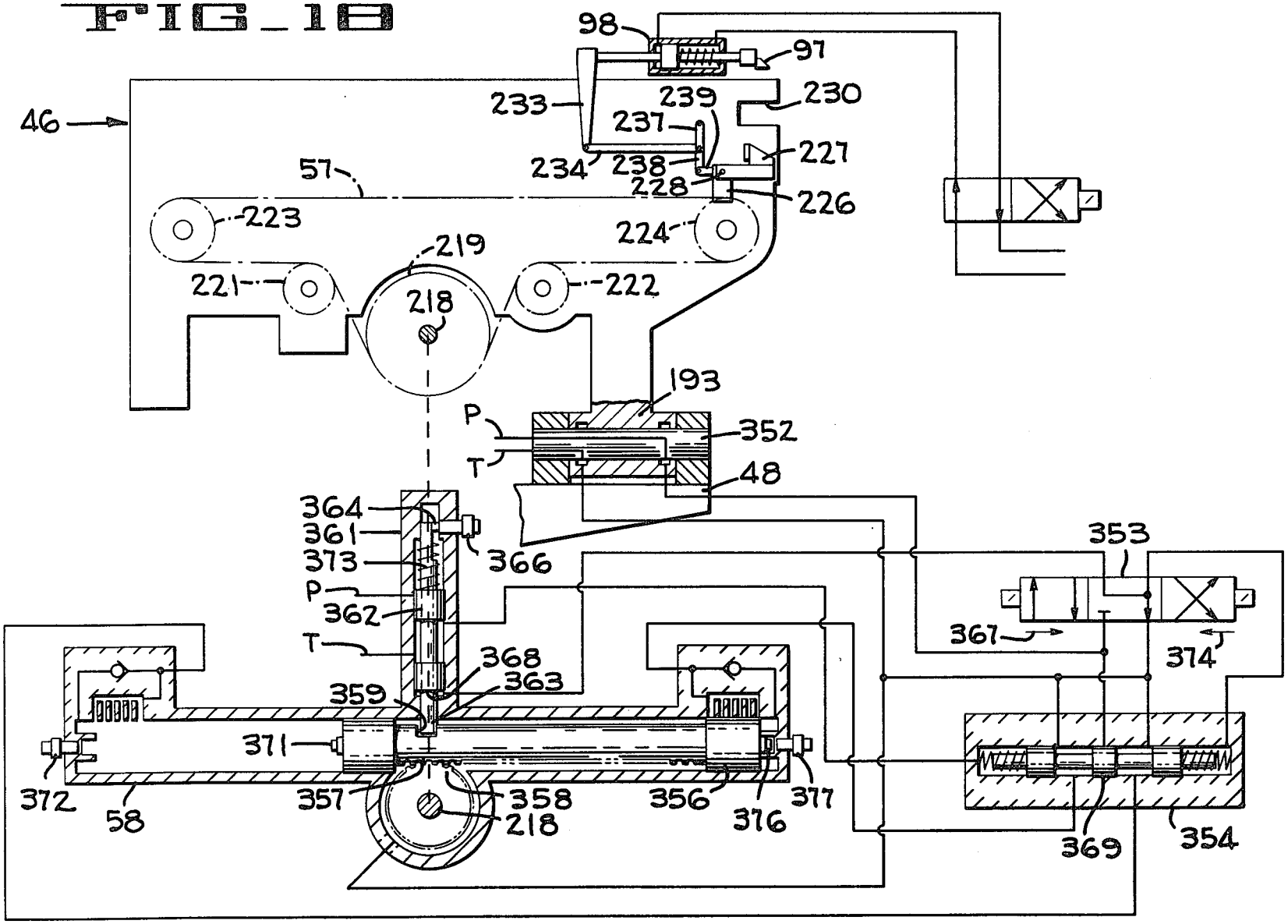
Figure 15:
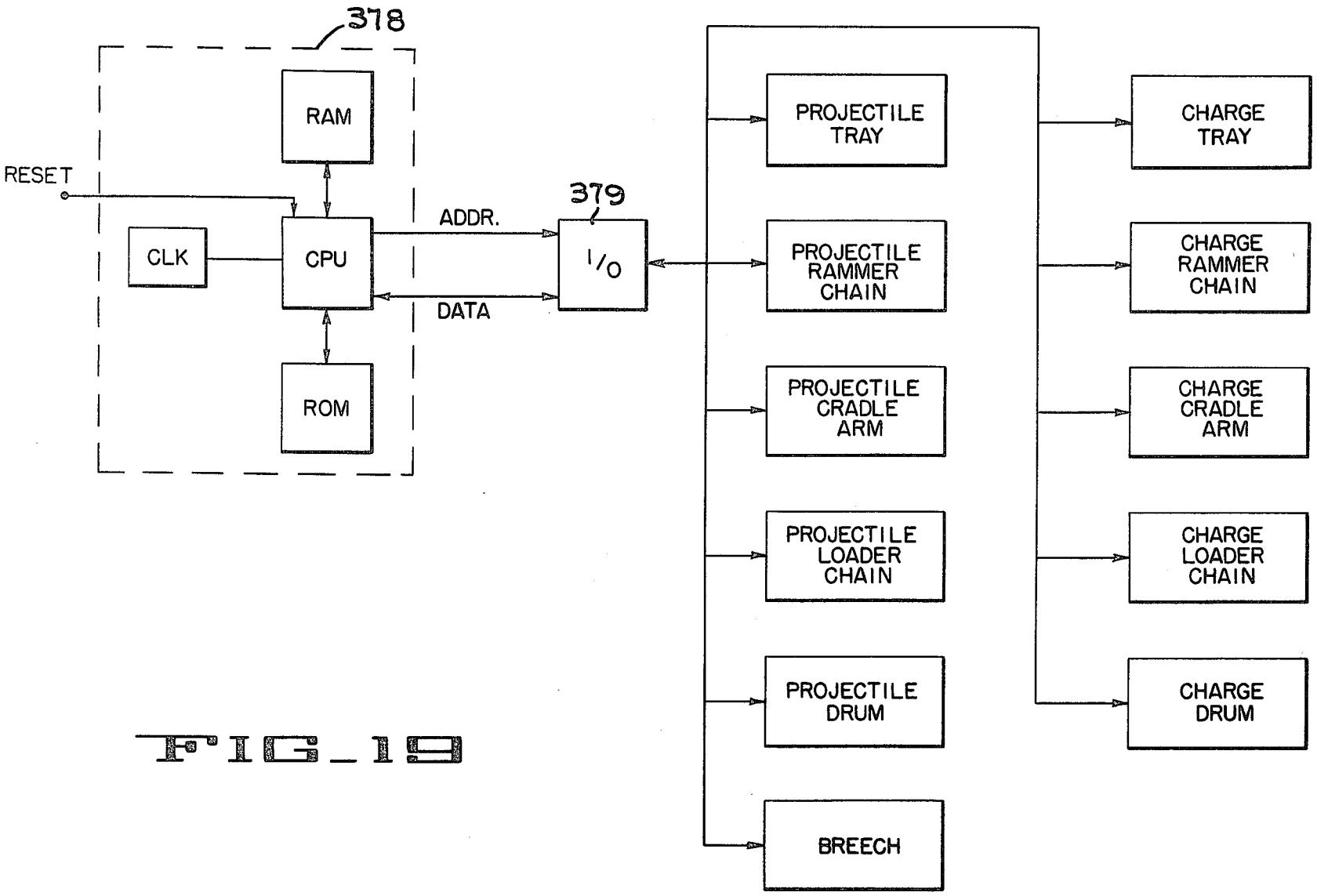

The hydraulic drive assembly 51 for the projectile transfer tray 46 is shown in FIG. 17 including the cylinder 202 and the pinion gear 201 attached to the shaft 194 which drives the transfer tray rotationally about the rotation axis 192 as seen in FIGS. 8 and 17. The hydraulic schematic for the transfer drive which positions the transfer tray in the receiving and loading positions shown in FIG. 9 is best described with reference to FIG. 17. A piston 332 is disposed for axial movement within the cylinder 202 and carries a rack 335 intermediate the ends thereof. The cylinder has a fixed stop 333 at one end thereof and a movable stop 334 at the other end. The cylinder also includes appropriate deceleration slots 336 at each end of the cylinder to slow the piston 332 as it approaches either end of the cylinder. Check valves 337 are also provided at each end of the cylinder so that unattenuated pressure may be readily applied to the ends of the piston to rapidly move it away from the stops 333 or 334.

For reference purposes, the position of the pivot axis 192 through the tray 46 as it is shown in FIG. 17 is taken to lie in the plane which includes the loading axis through the center of the breech 28. A tray position pilot valve 326 is provided which is coupled to a valve block 327 through appropriate hydraulic lines. A pressure line P and a return line T coupled to a hydraulic reservoir are connected to the valve block. The valve block 327 contains a control valve 328 having a piston 329 therein which is spring loaded to a centered or neutral position as shown. The tray lock cylinder 203 is shown as being defined within the valve block 327. A piston 331 is disposed for axial movement within the cylinder 203. The piston has an extension which passes through a seal in the wall of the valve block and which carries the transfer tray position latch 204 on the end thereof. When the pilot valve 326 is solenoid actuated in the direction of the arrow 338 pressure is applied to the upper end of the control valve 328 (FIG. 17) thereby forcing the piston 329 in a downward direction. Pressure is thereby routed through the control valve to the lock cylinder 203 and is applied against a shoulder 339 on the piston 331. The piston is raised in the cylinder disengaging the latch 204 from the tray position detent member 199. Pressure is also routed at this time to the lower end of the cylinder 202. The piston 332 is thereby forced against the stop 333 in the cylinder 202 and the rack 335 engages the pinion gear 201 to drive the tray 46 to the position shown in FIG. 17. When the tray position pilot valve 326 is solenoid actuated in the direction shown by arrow 341 pressure is applied to the lower end of the control valve 328 forcing the piston 329 upwardly. Pressure is therefore communicated through the control valve to a shoulder 342 on the piston 331 in the tray lock cylinder and the piston 331 is raised to disengage the latch member 204 from the shoulder 209 on the detent member 199. Pressure is thereby communicated through the lock cylinder 203 to the upper end of the cylinder 202 driving the piston 332 off of the stop 333. The rack 335 on the piston drives the pinion gear 201 in a clockwise direction as seen in FIG. 17 to cause the tray 46 to assume one of the inner or outer sleeve receiving positions. If the outer receiving position is selected the stop 334 is positioned as seen in FIG. 17 and the rotation of the shaft 194 will be stopped with the notch 206 in the detent member 199 lying below the latch member 204. When the actuation signal is subsequently removed from the pilot valve 326 it returns to the neutral position shown and pressure is relieved in the lock cylinder 203. The lock member 204 falls into the notch 206 thereby locking the tray at the position for receiving projectiles from the outer ring of sleeves 59. If the stop 334 is positioned to select the receiving position aligned with the inner ring of sleeves in the storage drum it is withdrawn slightly in the cylinder 202 and the shaft 194 will rotate to a position such that the shoulder 207 on the deten member is contacted by the latch member 204 when pressure in the lock cylinder 203 is removed. The tray is thus locked in a position to receive projectiles from the inner ring of sleeves 59. A magnet 330 is mounted on the lock cylinder piston 331 and when the latch member 204 is lowered to be in engagement with the detent member 199 the magnet is aligned with a proximity switch 340 mounted on the lock cylinder 203. The switch output therefore provides an indication as to whether the transfer tray 46 is in either the latched or the unlatched condition.

A tray receiving position pilot valve 343 is seen in FIG. 17 in a neutral position as shown. When it is desired to drive the transfer tray 46 to the receiving position aligned with a storage drum sleeve 59 in the inner ring of sleeves, the pilot valve 343 is solenoid actuated in the direction indicated by arrow 344. The pressure line P and the return line T are coupled to the pilot valve. With actuation in the direction of arrow 344 pressure is routed through the pilot valve to the upper end of a stop adjustment cylinder 346 and is thereby exerted against the upper side of a stop drive piston 347 contained within the cylinder. The piston has an arm 348 attached thereto which extends through a sealed opening in the cylinder 346. The arm is connected to the adjustable stop 334. With the aforementioned actuation (arrow 344) the stop is extended axially in the cylinder 202 through a distance equivalent to the stroke of the piston 347. The piston 332 may now travel within the cylinder 202 through a greater axial distance thereby turning the pinion gear 201 and shaft 194 through a greater angle. The tray 46 may therefore be moved to the receiving position aligned with the inner ring of chambers. As is clear from FIG. 17 solenoid actuation of the tray receiving position pilot valve 343 in the direction of the arrow 349 directs pressure to the cylinder 346 having a sense which urges the piston 347 into the position shown in the Figure so that the transfer tray may only be driven to a position of alignment with the outer ring of chambers in the storage drum.

The hydraulic drive system for the rammer pawl 227 in the transfer tray 46 is shown schematically in FIG. 18. The hydraulic slip joint 193 is shown rotatable upon a center shaft 352 attached to the cradle arm 48. The slip joint transfers hydraulic pressure P and hydraulic return T between the cradle arm and the tray as shown diagrammatically and in a fashion which is well known to those of skill in this art. The hydraulic lines are coupled to a rammer pawl pilot valve 353 and to a control valve block 354. The hydraulic pressure and return lines are coupled through the control valve block to the rammer chain hydraulic drive cylinder 58. The cylinder contains a piston 356 disposed for axial movement therein and having a rack 357 formed on one side there of. The rack is meshed with a pinion 358 which is fixed on the output shaft 218. Axial motion of the piston within the cylinder 58 therefore provides rotation of the rammer chain drive sprocket 219 as described hereinbefore.

The piston 356 has a detent 359 formed therein near one end (FIG. 18). A rammer chain lock cylinder 361 is attached to the side of the drive cylinder 58 holding an axially movable piston 362 therein. The piston is spring loaded in a direction which causes a latch projection 363 to extend through a seal in the end of the piston. The latch projection is formed to enter the detent 359 when the piston 356 is in the position shown in FIG. 18 to thereby lock the rammer chain drive in a position with the rammer pawl retracted. A magnet 364 is mounted on the piston 362. A proximity switch 366 is mounted in the wall of the cylinder 361 in a position adjacent to the magnet when the piston is positioned so that the latch projection 363 is extended from the piston. In this fashion, the switch state indicates whether the piston in the drive cylinder 58 is in a latched or an unlatched position.

When the rammer pawl pilot valve 353 is solenoid actuated in the direction of the arrow 367, pressure is communicated through the pilot valve to the cylinder 361 and is exerted against a shoulder 368 on the piston 362. The piston is therefore raised within the lock cylinder 361 and the latch projection 363 is removed from the detent 359 in the piston 356. A return line T attached to the lock cylinder is blanked off by the piston 362 and a pressure line P is communicated through the lock cylinder with the left end of the control valve block 354 (FIG. 18). Pressure is therefore exerted against the left end of a piston 369 in the control valve, which is normally spring loaded to a neutral position as shown. Pressure is consequently routed through the control valve to the right end of the cylinder 58 to thereby drive the unlocked piston 356 against the stop on the left end of the rammer chain drive cylinder. The linear motion of the rack 357 causes the pinion 358 and the shaft 218 to rotate in a counterclockwise direction, as seen in FIG. 18, and the rammer chain 57 is driven to move the rammer pawl 227 toward the discharge end of the transfer tray 46. The rammer chain is driven at a high enough speed so that a projectile 64 in the tray reaches a speed such that projectile inertia will carry the projectile against a stop within the breech 28 after the rammer pawl motion is arrested. A magnet 371 is mounted on the end of the piston 356 and is positioned adjacent to a proximity switch 372 when the rack is moved to the left in FIG. 18 and the rammer pawl 227 is in the extended position near the left end of the transfer tray 46. The proximity switch 372 therefore provides an indication of rammer chain extension.

When the rammer pawl pilot valve 353 is allowed to return to a neutral position, as shown in FIG. 18, pressure is relieved from the shoulder 368 on the lock cylinder piston and the piston is returned by a coil spring 373 to extend the latch projection 363 to contact the piston 356. When the pilot valve is solenoid actuated in the direction indicated by the arrow 374 pressure is coupled through the pilot valve to the right end of the piston 369 in the control valve block 354. The piston is moved to the left as seen in FIG. 18 and pressure is coupled to the left end of the rammer chain drive cylinder 58. The piston 356 is therefore driven to the right end of the cylinder and the rammer chain 57 moves to retract the rammer pawl 227 to the position shown in the Figure as the drive sprocket 219 is rotated in a clockwise direction. Another magnet 376 is mounted on the right end of the rammer chain drive piston, and when the drive piston is positioned adjacent to a proximity switch 377 the switch provides an output indicating the rammer pawl is in the retracted position. The latch projection 363 is forced into the detent 359 on the cylinder when the cylinder reaches the position shown in FIG. 18. The cylinder 58 is shown having deceleration apertures and check valves as shown hereinbefore in conjunction with the description of the tray drive cylinder 202 in FIG. 17.

In a preferred embodiment of the automated loader, the operating sequence for the component parts of the system is controlled by a microprocessor 378, as seen in FIG. 19. The microprocessor includes the usual random access (RAM) and read only (ROM) memories and a central processing unit (CPU). Address and data information is passed through an input-output section 379 to the major subsystems within the loading system herein described. There are five major subsystems for the handling of projectiles and five major counterpart subsystems for the handling of the propellant charges. These subsystems, as illustrated in FIG. 19, comprise the storage drum subsystems, the loader chain subsystems, the cradle arm subsystems, the rammer chain subsystems and the transfer tray subsystems. The construction of the breech which provides opening and closing is well known, and since it is not considered to be a part of the instant invention, it is not described in detail herein. The breech block is closed immediately after the rammer chain has fully extended and the proximity switch 372 is actuated as described in the discussion of FIG. 18 hereinbefore. As soon as the charge is fired the breech block is opened. The operation of the breech block both in closing and opening is automatically controlled and hydraulically powered. The initiation of the block opening is accomplished in this embodiment by valving which is actuated at the initiation of counter-recoil.

A typical operational sequence is hereinafter recited. It should be realized that some of the sequential operations may be performed simultaneously and are commanded by the microprocessor in accordance with an appropriate program entered into the read only memory. The microprocessor rapidly and continuously interrogates the various condition indicative proximity switches described hereinbefore and uses the condition indications to provide the proper operation sequencing. Initially, it will be assumed that both storage drums contain ammunition components, both transfer trays are loaded, one with a projectile and the other with a propellant charge, the cradle arms are aligned in elevation with the gun tube 27, the trays are "raised" into a position such that they are on an arc which passes through one of the receiving positions for the inner or the outer sleeves in the storage drums, the rammer pawls in the transfer trays are both retracted and the loader chain pawls in both storage drums are retracted.

1. Open breech.
2. Rotate the projectile tray around the tray pivot axis to align it with the breech.
3. Load the projectile into the breech by extending the rammer pawl.
4. Rotate the projectile tray about the tray pivot axis to align the tray with the arc intercepting the receiving position for the inner or the outer storage drum sleeves.
5. Rotate the propellant tray about the tray pivot axis to align it with the breech.
6. Retract the projectile rammer pawl in the projectile tray.
7. Load the propellant into the breech by extending the rammer pawl.
8. Align the projectile cradle arm with the drums at 0° elevation.
9. Index the projectile drum to bring the next load into alignment with the transfer tray receiving position.
10. Rotate the propellant tray about tray pivot axis to alignment with the arc intercepting the receiving position for the inner or the outer ring of storage drum sleeves.
11. Release the projectile holding mechanism, depress the rammer pawl and extend the appropriate loader chain in the projectile storage drum to load a projectile into the tray.
12. Close the breech.
13. Retract the propellant rammer pawl in the propellant transfer tray.
14. Fire.
15. Align the propellant cradle arm with the propellant charge storage drum at 0° elevation.
16. Index the propellant charge drum to bring the next load into alignment with the appropriate transfer tray receiving position.
17. Capture the projectile in the projectile transfer tray with the rammer pawl.
18. Align the projectile cradle arm with the gun tube elevation.
19. Retract the projectile loader chain in the projectile storage drum.
20. Release the propellant charge holding mechanism, depress the rammer pawl and load the propellant charge into the propellant transfer tray by extending the appropriate loader chain in the propellant storage drum.
21. Open the breech.
22. Rotate the projectile tray about the tray pivot axis to align it with the breech.
23. Capture the propellant charge in the propellant transfer tray with the rammer pawl.
24. Align the propellant charge cradle arm with the gun tube elevation.
25. Retract the propellant charge loader chain in the propellant storage drum.

Return to step three hereinbefore and continually repeat the sequence to deliver a series of projectiles and propellant charges in proper sequence to the breech.

A "load mode" is selectable in the system which deactivates all of the system except the index drives for the projectile and propellant charge drums and the drum locks. A storage drum position is selected and ammunition is placed in the sleeves in the drum which are indexed to be aligned with the receiving positions for the transfer trays. The rounds are placed into the sleeves through the backs of the drums. The loading position information is entered into random access memory so that the memory retains the data relating to specific round locations and types. An alternative method of loading the drums where specific positions of the rounds need not be retained in RAM involves temporary removal of the structure at the rear of the drums (for example by swinging the structure to one side on hinges or pivots, not shown) and randomly loading the projectiles and propellant charges in their respective storage drums.

Although the best mode contemplated for carrying out the present invention has been herein shown and described, it will be apparent that modification and variation may be made without departing from what is regarded to be the subject matter of the invention.

What is claimed is:

1. A system providing rapid transfer of ammunition rounds to a breech of a cannon which is independently movable in both azimuth and elevation positions, comprising:

means mounted in fixed azimuthal relation with the cannon for azimuthal movement therewith for storing an array of ammunition round components, said means for storing being indexable about a substantially horizontally disposed indexing axis and including a projectile store having a plurality of chambers therein accepting the projectiles, a propellant charge store having a plurality of chambers therein accepting the charges, and being non-movable with said cannon in elevation;

a projectile and a propellant charge support tray adapted to receive the ammunition rounds from said array and movable between receiving positions adjacent said means for storing and loading positions adjacent the breech;

a projectile and a propellant charge cradle arm each independently rotatable about an elevation axis for the cannon;

means for pivotally attaching said projectile and propellant charge support trays to respective projectile and propellant charge cradle arms and for providing rotational movement of said tray between said receiving and loading positions;

means for indexing each of said stores to bring predetermined ones of said plurality of chambers adjacent to said receiving position;

means for transferring ammunition rounds from said means for storing to said support trays in said receiving positions;

means for loading ammunition rounds into the breech from said support trays when in said loading positions;

and computer means coupled to and both sequentially and simultaneously interrogating the positions of and providing actuating commands for said means for storing, means for transferring, cradle arms, support trays and means for loading to thereby deliver a series of ammunition rounds from said array to the breech.

2. The system of claim 1 wherein said means for transferring comprises a pawl adapted to contact said ammunition round components, a drive chain attached to said pawl, and means for driving said drive chain so that said pawl contacts and moves ones of said ammunition rounds from said means for storing.

3. A system as in claim 1 wherein said computer means may be instructed to enter a loading mode, said computer means thereby deactivating all of the system except said means for storing, said last named means receiving round components through the chamber ends opposite from those proximate to said receiving positions, and means for providing round component storage information into memory in said computer means.

4. A system for automatically loading ammunition rounds into the breech of a cannon which is movable about elevation and azimuth axes and which has a loading axis aligned with the breech, wherein the loading axis moves in a loading axis plane when the cannon is moved in elevation comprising:

a rotatable drum having an axis of rotation substantially perpendicular to a plane in which the elevation and azimuth axes are included and having a plurality of storage chambers therein including an inner ring and an outer ring of storage chambers for storing an array of ammunition rounds, said drum being fixed in azimuth position relative to the cannon, means for shifting said array about said drum rotation axis so that the rounds are brought into alignment with an inner ring and an outer ring transfer position adjacent thereto, a cradle arm mounted on the elevation axis and free to rotate thereabout in a plane parallel to the loading axis plane, a round receiving tray disposed for pivotal movement on said cradle arm, means for driving said tray pivotally about an axis in said cradle arm rotation plane between either of said inner and outer transfer positions and a position in the loading axis plane, and means for driving said cradle arm rotationally between a position in which said tray may be pivoted to be aligned with the loading axis and a position in which the tray may be aligned in either of said transfer 5. An ammunition handling system for a large caliber cannon movable in azimuth and elevation and having a breech which moves in a breech elevation plane, wherein the breech is adapted to receive a projectile and a propellant charge, comprising:

a projectile storage drum having a plurality of projectile storage sleeves therein;

a propellant charge storage drum having a plurality of propellant charge storage sleeves therein;

means for mounting said drums in fixed azimuthal relation with the cannon;

a projectile cradle arm mounted for elevation rotation relative to the cannon;

a propellant charge cradle arm mounted for elevation rotation independent of said projectile cradle arm and relative to the cannon;

a projectile tray disposed for movement between a position aligned with ones of said projectile storage sleeves and a position aligned with the breech elevation plane;

a propellant charge tray disposed for movement between a position aligned with ones of said propellant charge sleeves and a position aligned with the breech elevation plane;

means for driving said trays between said sleeve and breech alignment positions;

means for rotationally indexing said drums so that selected ones of said projectile and propellant charge sleeves are positioned in alignment with said trays;

means mounted on said storage drums for moving the projectiles and the propellant charges from said projectile and propellant charge drums to said projectile and propellant charge trays respectively when said trays are aligned with said storage sleeves;

means mounted on said projectile and propellant charge trays for sequentially transferring the projectiles and the propellant charges from said trays to the breech when aligned with said breech, and computer means for continuously interrogating the positions of and coupled to said means for indexing, means for moving, means for driving and means for transferring and for providing appropriate sequential and simultaneous actuating commands for the same so that projectiles and propellant charges are moved from said sleeves into the breech.

6. A system for rapidly transferring a series of projectiles and propellant charges to a breech of a large caliber cannon mounted on a carriage which is movable in azimuth, comprising:

means mounted on the carriage for holding a plurality of projectiles and propellant charges and for bringing ones thereof to projectile and propellant charge transfer positions, said last named means including a projectile drum having a plurality of projectile storage sleeves therein, a propellant charge drum having a plurality of propellant charge storage sleeves therein, and means indexing said drums rotationally to bring storage sleeves containing projectiles and propellant charges to said respective projectile and propellant charge transfer positions;

a projectile transfer tray disposed for movement between a receiving position aligned with said projectile transfer position and a loading position aligned with the breech;

a propellant charge transfer tray disposed for movement between a receiving position aligned with said propellant charge transfer position and said loading position;

means for transferring projectiles and propellant charges from said means for holding to said projectile transfer tray and said propellant charge transfer tray respectively when said trays are in said receiving positions;

means for loading said projectiles and propellant charges into the breech when said respective transfer trays are in said loading position; and means for positioning said transfer trays at said receiving and loading positions;

said projectile and propellant charge drums each having an inner and an outer ring of storage sleeves at said transfer positions and said means for positioning said transfer trays including a selector operating to position said trays selectively at inner and outer receiving positions.

7. A system for rapidly transferring a series of projectiles and propellant charges to a breech of a large caliber cannon mounted on a carriage which is movable in azimuth, the cannon being movable on the carriage about a cannon elevation axis, comprising:

means mounted on the carriage for holding a plurality of projectiles and propellant charges and for bringing ones thereof to projectile and propellant charge transfer positions;

a projectile transfer tray disposed for movement between a receiving position aligned with said projectile transfer position and a loading position aligned with the breech;

a propellant charge transfer tray disposed for movement between a receiving position aligned with said propellant charge transfer position and said loading position;

means for transferring projectiles and propellant charges from said means for holding to said projectile transfer tray and said propellant charge transfer tray respectively when said trays are in said receiving positions;

means for loading said projectiles and propellant charges into the breech from said transfer trays when said respective transfer trays are in said loading position; and means for positioning said transfer trays at said receiving and loading positions;

said means for holding including a drum;

said means for positioning said transfer trays including a pair of cradle arms mounted for rotational movement about the cannon elevation axis, a transfer tray arm rotatably mounted on each of said cradle arms and having the associated tray attached thereto and providing tray movement between a raised position and a lowered position, said raised position coinciding with said receiving position when said cradle arm is at the elevation of said drum and said lowered position coinciding with said loading position when said cradle arm is aligned in elevation with the cannon, means for driving said cradle arms between the position in alignment with the cannon and the position at the elevation of said drum, and means for driving said tray arm between said raised and lowered positions;

and computer means for continuously interrogating the positions of and commanding actuation of said means for holding, transfer trays, means for transferring, means for loading and means for positioning in appropriate sequential and simultaneous fashion so that a succession of projectiles and propellant charges are positioned within the breech.

8. The system of claim 7 wherein said means for transferring comprises a loader chain, a loader pawl attached to said loader chain adapted to contact the ends of the projectiles and propellant charges in said means for holding, and means for driving said loader chain so that said pawl pushes against and ejects projectiles and propellant charges into said respective transfer trays from respective ones of said projectile and propellant charge transfer positions.

9. The system of claim 7 wherein said means for transferring comprises:

a projectile loader chain, a propellant charge loader chain, a loader pawl attached to each of said loader chains, said pawls being adapted to contact the rearward ends of the projectiles and propellant charges in said means for holding, and means for driving said loader chains so that said pawls eject projectiles and propellant charges into respective ones of said transfer trays from said respective transfer positions.

10. A system as in claim 7 wherein said means for loading comprises means in contact with projectiles and propellant charges for urging same from said transfer trays into said breech and means for arresting the motion of said means in contact when the projectiles and propellant charges have reached a predetermined velocity, whereby projectiles and propellant charges are thrown into the breech.

11. A system as in claim 7 wherein said means for holding, transfer trays, means for transferring, means for loading and means for positioning include position sensing means providing outputs coupled to said computer means, whereby said aforementioned position sensed structure may be directed to move in said sequential and simultaneous fashion in accordance with a program entered into said computer means.

12. A method of transferring ammunition round components from inner and outer projectile and propellant receiving positions at a store for projectiles and propellant charges into the breech of a cannon from a loading position aligned therewith, wherein projectile and propellant charge trays are rotatably mounted on projectile and propellant charge cradle arms rotatable about the cannon elevation axis, comprising the steps of selecting between the inner and the outer projectile receiving positions, aligning the projectile cradle arm with the store elevation when the projectile tray is aligned with the arc including the selected projectile receiving position, indexing the projectile store to bring the next projectile into alignment with the selected projectile receiving position, selecting between the inner and the outer propellant receiving positions, rotating the propellant tray into alignment with the arc including the selected propellant receiving position, urging the projectile into the transfer tray from the store, aligning the propellant cradle arm with the store elevation, indexing the propellant store to bring the next propellant charge into alignment with the selected propellant receiving position, aligning the projectile cradle arm with the current cannon elevation, urging the propellant charge into the transfer tray from the store, opening the cannon breech, rotating the projectile tray on the projectile cradle arm into the loading position, aligning the propellant charge cradle arm with the current cannon elevation, loading the projectile into the breech, making the next selection between inner and outer projectile receiving positions, rotating the projectile tray into alignment with the arc including the next selected projectile receiving position, rotating the propellant tray on the propellant cradle arm into the loading position, loading the propellant charge into the breech, making the next selection between inner and outer propellant receiving positions, rotating the propellant tray into alignment with the arc including the next selected propellant receiving position, and closing the cannon breech.

* * * * *